US009498892B2

(12) United States Patent
Nakasuka et al.

(10) Patent No.: US 9,498,892 B2
(45) Date of Patent: Nov. 22, 2016

(54) PIVOTING RAZOR

(75) Inventors: Hiroyuki Nakasuka, Seki (JP); Daisuke Haba, Seki (JP)

(73) Assignee: KAI R&D CENTER CO., LTD., Gifu-ken (JP)

( * ) Notice: Subject to any disclaimer, the term of this patent is extended or adjusted under 35 U.S.C. 154(b) by 184 days.

(21) Appl. No.: 14/116,172

(22) PCT Filed: May 15, 2012

(86) PCT No.: PCT/JP2012/062355

§ 371 (c)(1),
(2), (4) Date: Dec. 12, 2013

(87) PCT Pub. No.: WO2012/157624

PCT Pub. Date: Nov. 22, 2012

(65) Prior Publication Data

US 2014/0096402 A1 Apr. 10, 2014

(30) Foreign Application Priority Data

May 18, 2011 (JP) ..... 2011-111346
Jan. 27, 2012 (JP) ..... 2012-015613

(51) Int. Cl.
*B26B 21/52* (2006.01)
*B26B 21/22* (2006.01)

(52) U.S. Cl.
CPC ..... *B26B 21/521* (2013.01); *B26B 21/225* (2013.01); *B26B 21/52* (2013.01)

(58) Field of Classification Search
CPC .... B26B 21/521; B26B 21/52; B26B 21/225
USPC ..... 30/531, 527, 50, 526
See application file for complete search history.

(56) References Cited

U.S. PATENT DOCUMENTS 5,168,628 A 12/1992 Mock et al.
5,560,106 A 10/1996 Armbruster et al.
5,706,582 A 1/1998 Hosokawa et al.

(Continued)

FOREIGN PATENT DOCUMENTS

CN 1135398 A 11/1996
GB 2 458 316 A 9/2009

(Continued)

OTHER PUBLICATIONS

International Search Report mailed on Jun. 12, 2012 for the corresponding International patent application No. PCT/JP2012/062355.

(Continued)

*Primary Examiner* — Omar Flores Sanchez
(74) *Attorney, Agent, or Firm* — Posz Law Group, PLC

(57) ABSTRACT

An elastic plate is located between the support portion at the head portion of the holder and the supported portion of the razor head. The outer circumference of the annular elastic portion of the elastic plate is supported by the inner circumference of the annular portion of the support portion. The supported portion of the razor head is inserted into the inner circumference of the annular elastic portion of the elastic plate. As a result of the support structure to support the razor head to be movable from a neutral position against the elastic force of the elastic plate, the razor head can be moved during use from the neutral position to positions in three dimensions against the elastic force of the elastic plate.

15 Claims, 11 Drawing Sheets

(56) References Cited

U.S. PATENT DOCUMENTS

| | | | | |
|---|---|---|---|---|
| 5,943,777 | A | 8/1999 | Hosokawa et al. | |
| 6,301,786 | B1 * | 10/2001 | Oswald et al. | 30/43.92 |
| 8,938,885 | B2 * | 1/2015 | Stevens | 30/527 |
| 2004/0020053 | A1 | 2/2004 | Wain | |
| 2009/0313837 | A1 * | 12/2009 | Winter et al. | 30/527 |
| 2010/0043242 | A1 * | 2/2010 | Stevens | 30/527 |
| 2011/0035950 | A1 * | 2/2011 | Royle | 30/532 |

FOREIGN PATENT DOCUMENTS

| | | | |
|---|---|---|---|
| JP | 04-022388 | A | 1/1992 |
| JP | 2004-511318 | A | 4/2004 |
| JP | 4308939 | B2 | 8/2009 |
| WO | 89/10245 | A1 | 11/1989 |
| WO | 2009-154921 | A2 | 12/2009 |

OTHER PUBLICATIONS

Office Action dated Nov. 15, 2014 issued in corresponding CN patent application No. 201280035230.0.

Extended European Search Report dated Nov. 18, 2014 issued in corresponding EP patent application No. 12784880.2.

International Preliminary Report on Patentability mailed on Nov. 19, 2013 for the corresponding International patent application No. PCT/JP2012/062355 (English translation only).

* cited by examiner 6
6a
12
12a
11
(S)
7 (P)
8
19
20
21
16
16b
15
15a
13
13a
14
10
40
40a
41
42
38
39
37
4
5

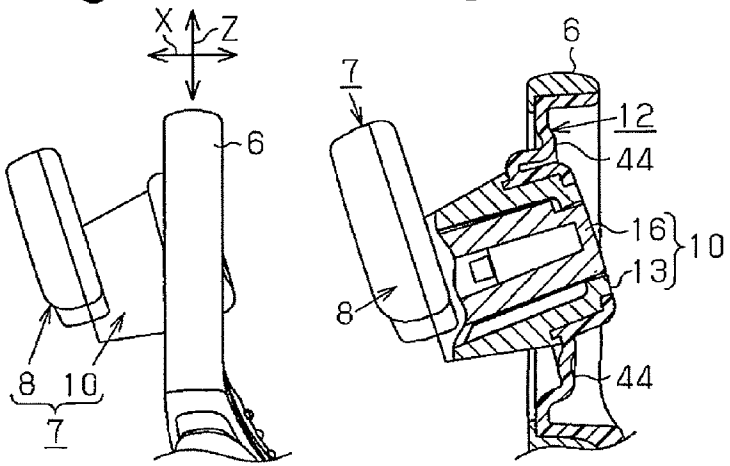
Fig.12(a)
Fig.12(c)
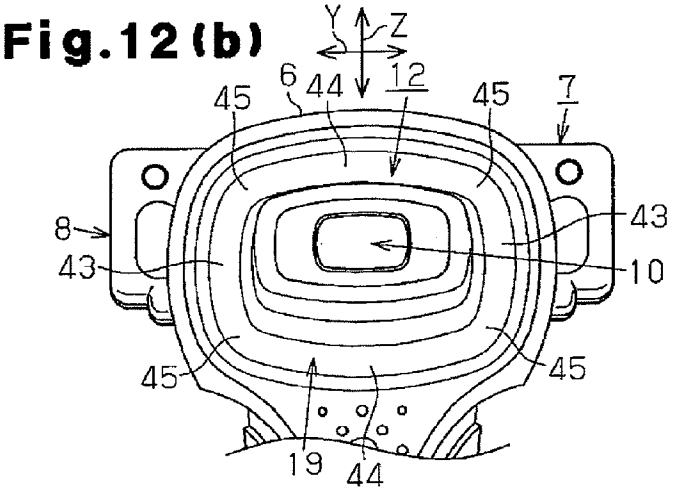
Fig.12(b)
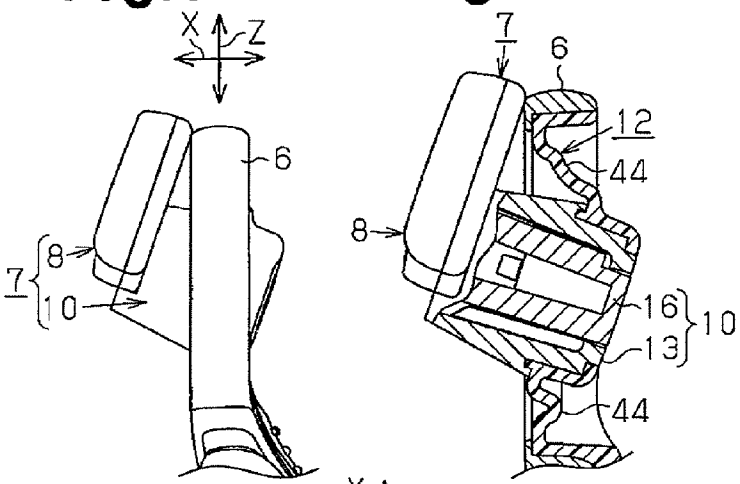
Fig.11(a)
Fig.11(c)
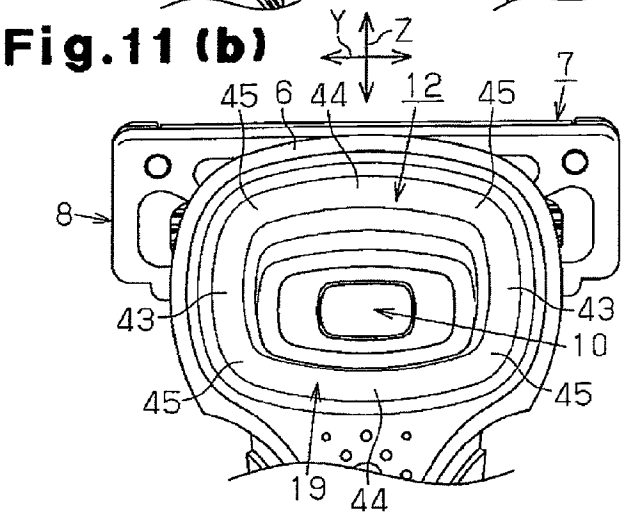
Fig.11(b)

PIVOTING RAZOR

CROSS REFERENCE TO RELATED APPLICATION

This application is a U.S. national stage application of PCT/JP2012/062355 filed on May 15, 2012, and claims priority to, and incorporates by reference, Japanese Patent Application Nos. 2011-111346 filed on May 18, 2011 and 2012-015613 filed on Jan. 27, 2012.

BACKGROUND

The present invention relates to a pivoting razor having a razor head, in which a blade body is mounted, so that the razor head can move against an elastic force with respect to a head portion of a holder.

A conventional safety razor is disclosed in Patent Document 1. The safety razor disclosed in Patent Document 1 includes a handle, a replaceable blade unit having a blade body, and a joint between the handle and the replaceable blade unit. The joint includes a pair of journal bearings to support the replaceable blade unit, and an elastic piece that urges the replaceable blade unit towards a neutral position of the replaceable blade unit. The handle includes a pivot shaft that pivotally supports the joint, and an elastic member that urges the joint towards a neutral position of the joint. Taking the neutral position of the replaceable blade unit as the reference position, the replaceable blade unit swings around the journal bearings against an elastic force produced by the elastic piece. In addition, taking the neutral position of the joint as the reference position, the joint, which supports the replaceable blade unit, swings together with the replaceable blade unit around the pivot shaft against the elastic force produced by the elastic piece.

PRIOR ART DOCUMENTS

Patent Documents

Patent Document 1: Japanese Laid-Open Patent Publication No. 4-22388

According to the safety razor disclosed in Patent Document 1, a swinging support structure is required with respect to the swinging direction that is centered on the journal bearings and with respect to the other swinging direction that is centered on the pivot shaft. This complicates the structure of the razor.

SUMMARY

An objective of the present invention is, in a pivoting razor including a holder having a head portion and a razor head having a blade body, to simplify a support structure for supporting the razor head with the head portion of the holder so that the razor head can be moved against an elastic force from a neutral position with respect to the head portion of a holder.

A pivoting razor according to one aspect of the present invention includes a holder having a head portion, and a razor head having a blade body. The pivoting razor includes a support portion provided in the head portion of the holder, a supported portion provided in the razor head, and an elastic portion that is arranged between the support portion and the supported portion. The razor head is arranged to be movable between a neutral position, in which the razor head is retained in a static state by the elastic portion, and a movement position, which is separated from the neutral position. The razor head moves from the neutral position to the movement position against an urging force of the elastic portion, and the razor head returns to the neutral position from the movement position by means of an urging force of the elastic portion. In this case, since the razor head can be supported by the elastic portion, the support structure that supports the razor head to be movable from the neutral position against an elastic force is simplified.

It is preferable that the elastic portion has an outer circumferential portion that is supported by the support portion of the head portion. In this case, since the outer circumferential portion of the elastic portion is supported by the support portion of the head portion, the inner side can be bent more than the outer circumferential portion of the elastic portion in the elastic portion.

It is preferable that the elastic portion supports the supported portion of the razor head at a position that is further inward than the outer circumferential portion of the elastic portion. In this case, since the supported portion is supported at the inner side of the outer circumferential portion, which is made easy to bend in the elastic portion, moving of the razor head against an elastic force is facilitated and it is also easy to return the razor head to the neutral position.

It is preferable that the elastic portion is an elastic plate. In this case, since the elastic portion is plate-shaped, it is easy to bend the inner side of the outer circumferential portion of the elastic portion at the elastic plate.

It is preferable that the supported portion of the razor head is supported by at least one of two side faces in a thickness direction of the elastic plate. In this case, moving of the razor head against an elastic force in the thickness direction of the elastic plate is facilitated and it is also easy to return the razor head to the neutral position.

It is preferable that the support portion of the head portion has an annular portion that extends in an annular fashion, the annular portion defines a support hole on an inner side thereof, and the elastic portion has an annular elastic portion, which is located in the support hole and between an inner circumference of the annular portion of the support portion and an outer circumference of the supported portion of the razor head in the support hole, wherein the annular elastic portion extends in an annular fashion along the inner circumference of the annular portion and the outer circumference of the supported portion. The annular portion of the support portion of the head portion may extend continuously in an annular fashion, or a plurality of support portions may be arranged in an annular fashion. In addition, the annular elastic portion of the elastic portion may extend continuously in an annular fashion, or a plurality of elastic portions may be arranged in an annular fashion. In this case, the annular elastic portion of the elastic portion can be bent in a support hole.

It is preferable that the elastic portion has a plurality of bending-allowing portions that have different deformation resistance degrees, which indicate a degree of difficulty of deformation. In this case, the shaving sensation can be changed by changing the deformation resistance degree of the elastic portion in accordance with the pivoting direction of the razor head.

It is preferable that the bending-allowing portions of the elastic portion are arranged adjacent to each other. In this case, the elastic portion having a plurality of bending-allowing portions with different deformation resistance degrees are easily provided.

It is preferable that the bending-allowing portions of the elastic portion are arranged to form an annular shape around the supported portion of the razor head. In this case, an elastic portion having a plurality of bending-allowing portions with different deformation resistance degrees are easily provided.

It is preferable that each facing pair of the bending-allowing portions in the elastic portion has the same deformation resistance degree. In this case, a favorable shaving sensation is obtained by providing an elastic portion to have the same deformation resistance degrees in the same pivoting directions of the razor head.

It is preferable that the bending-allowing portions of the elastic portion change shape as the razor head moves from the neutral position to a movement position, and that the deformation resistance degree of the bending-allowing portions at the movement position is higher than the deformation resistance degree of the bending-allowing portions at the neutral position. In this case, the shaving sensation is softened at the start of pivoting and the razor head is stabilized at the end of pivoting, and thus the shaving sensation is improved.

It is preferable that the holder includes a grip portion provided integrally with the head portion, and that the grip portion is formed integrally with the elastic portion of the head portion and has an exposed finger contact portion. In this case, the holder having the elastic portion and the finger contact portion is easily formed.

It is preferable that the elastic portion has a hardness within a range of 20 Shore A to 60 Shore A. In this case, the elastic portion is made with a moderate deformation resistance degree to enhance the shaving sensation at the time of use.

It is preferable that when the razor head is at the neutral position, the elastic portion is located inside the support hole and between the annular portion of the support portion and the supported portion of the razor head. In this case, pivoting of the razor head is not hindered by being inadvertently contacted by the elastic portion at the time of use, and thus the usability of the razor is improved.

It is preferable that the supported portion of the razor head includes a first connection portion that extends from a blade-body assembly portion in which the blade body is mounted, a second connection portion with the elastic portion being located between the support portion of the head portion and the second connection portion, and a coupling portion at which the first connection portion and the second connection portion support each other, wherein, when the razor head is at the neutral position, an end portion that is separated from the blade-body assembly portion in the second connection portion is located in the support hole. In this case, pivoting of the razor head is not obstructed by being inadvertently contacted by the second connection portion of the supported portion of the razor head at the time of use, and thus the usability of the razor is improved.

Preferably, the annular portion of the support portion of the head portion continuously extends in an annular fashion. In this case, the annular elastic portion of the elastic portion is supported by the continuously extending annular portion of the support portion, and the annular elastic portion of the elastic portion can be bent in a support hole.

The annular elastic portion of the elastic portion is formed in a continuous annular shape. In this case, the continuous annular elastic portion of the elastic portion is supported by the annular portion of the support portion, and the annular elastic portion of the elastic portion can be bent in a support hole.

The razor head can move to various movement positions. In this case, with a simple support structure, the razor head can be moved from the neutral position to various movement positions against an elastic force. The supported portion of the razor head has an extended portion that extends at the inner circumference of the annular elastic portion of the elastic portion, and the elastic portion can move and bend in the direction of an axis in the extending direction of the extended portion or in a direction transverse to the axis. In this case, the razor head can be moved from a neutral position against an elastic force to movement positions in three-dimensional directions.

Preferably, the elastic portion has a bending-allowing portion. For example, the bending-allowing portion continuously extends in an annular fashion around the extended portion, and has a ridge portion that protrudes along an axis and a groove portion that is formed on the back of the ridge portion. In this case, the annular elastic portion of the elastic portion can be easily bent by means of the bending-allowing portion.

Preferably, the elastic portion is provided separately to the support portion of the head portion and the supported portion of the razor head, and is connected to the support portion and the supported portion. In this case, it is easy to form the elastic portion, the support portion of the head portion, and the supported portion of the razor head.

Preferably, the supported portion of the razor head has a first connection portion that extends from the blade-body assembly portion, in which a blade body is mounted, a second connection portion with the elastic portion being located between the support portion of the head portion and the second connection portion, and a coupling portion at which the first connection portion and the second connection portion support each other. In this case, it is easy to form the supported portion of the razor head.

Preferably, the first connection portion and the second connection portion of the supported portion of the razor head are supported to be undetachable from each other at the coupling portion. In this case, it is easy to form the supported portion of the razor head.

Preferably, the first connection portion and the second connection portion of the supported portion of the razor head are supported to be attachable and detachable at the coupling portion. In this case, the assembly portion, in which a blade body is mounted in the razor head, can be replaced.

Preferably, a latching recess provided in the first connection portion and a latching protrusion provided in the second connection portion are attached to and detached from each other. In this case, at the coupling portion, the first connection portion and the second connection portion can be attached and detached by means of the latching recess and the latching protrusion.

Preferably, at the coupling portion, the second connection portion and the first connection portion are attached to each other by magnetic force. In this case, the first connection portion and the second connection portion can be selectively attached to each other by magnetic force or separated from each other against the magnetic force at the coupling portion.

Preferably, at the coupling portion, an operation portion is provided that causes the second connection portion and the first connection portion to be attached to or detached from each other. In this case, the first connection portion and the second connection portion can be attached or detached by means of the operation portion at the coupling portion.

Preferably, the elastic portion is formed by placing the support portion of the head portion and the supported portion of the razor head inside a mold and supplying material into a cavity in the mold. In this case, the elastic portion can be integrally attached to the support portion of the head portion and the supported portion of the razor head.

The cutting edge of the blade body in the razor head extends in the horizontal direction. preferably, the respective bending-allowing portions of the elastic portion include: a left-side bending-allowing portion and a right-side bending-allowing portion that face each other in the horizontal direction; an upper-side bending-allowing portion and a lower-side bending-allowing portion that face each other in a vertical direction that is perpendicular to the horizontal direction; and four corner bending-allowing portions that face each other in diagonal directions at four corners between the left and right bending-allowing portions and the upper and lower bending-allowing portions, respectively. In addition, with respect to deformation resistance degrees of the corner bending-allowing portions, preferably a deformation resistance degree of the left and right bending-allowing portions is higher than a deformation resistance degree of the upper and lower bending-allowing portions. In this case, pivoting of the razor head in the horizontal direction and vertical direction is facilitated and the pivoting action is stabilized.

Preferably, the left-side bending-allowing portion and the right-side bending-allowing portion have the same deformation resistance degree as each other, the upper-side bending-allowing portion and the lower-side bending-allowing portion have the same deformation resistance degree as each other, and the respective corner bending-allowing portions have the same deformation resistance degree. In this case, the respective deformation resistance degrees of portions of the elastic portion facing each other in the pivoting direction of the razor head are equal, and thus a favorable shaving sensation is obtained.

Preferably, the deformation resistance degree of the bending-allowing portion increases as the razor head moves from the neutral position to a movement position. In this case, the shaving sensation is softened at the start of pivoting and the razor head is stabilized at the end of pivoting, and thus the shaving sensation is improved.

Preferably, the supported portion of the razor head includes: a first connection portion that extends from a blade-body assembly portion in which a blade body is mounted; a second connection portion with the elastic portion being located between the support portion of the head portion and the second connection portion; and a coupling portion at which the first connection portion and the second connection portion support each other. Further, at the coupling portion, the first connection portion and the second connection portion can support each other only when the first connection portion and the second connection portion are in a predetermined positional relationship. In this case, a position at which the first connection portion and the second connection portion of the supported portion of the razor head can be coupled is limited, and the orientation of the razor head with respect to the holder is made constant.

Preferably, the supported portion of the razor head has a first connection portion that extends from the blade-body assembly portion, in which a blade body is mounted, a second connection portion with the elastic portion being located between the support portion of the head portion and the second connection portion, and a coupling portion at which the aforementioned connection portions are supported such that the connection portions can be attached to or detached from each other. In addition, preferably, at a portion of the first connection portion that is separated from the blade-body assembly portion, the first connection portion has an operation portion that protrudes to separate from the second connection portion. In this case, the razor head can be easily attached to and detached from the holder by means of the operation portion.

Preferably, the grip portion has a main body portion that is integrally formed with the support portion of the head portion, and the finger contact portion is exposed from the main body portion. In this case, the holder having the elastic portion, the finger contact portion, and the main body portion can be easily formed.

Preferably, in the first connection portion, an end portion that is separated from the blade-body assembly portion is arranged in the support hole when the razor head is at the neutral position. In this case, pivoting of the razor head is not hindered by being inadvertently contacted by the first connection portion of the supported portion of the razor head at the time of use, and thus the usability of the razor is improved.

The present invention can, in a pivoting razor, simplify a support structure that supports a razor head in a head portion of a holder, so that the razor head, in which a blade body is mounted, can be moved against an elastic force from a neutral position with respect to the head portion of the holder.

BRIEF DESCRIPTION OF THE DRAWINGS

FIG. 1(*b*) is a rear view of the pivoting razor in the neutral state;

FIG. 1(*c*) is a front view of the pivoting razor in the neutral state;

FIG. 1(*d*) is a side view of the pivoting razor in the neutral state;

FIG. 2(*b*) is a partial enlarged view of FIG. 1(*d*), showing the pivoting razor in the neutral state;

FIG. 2(*c*) is a partial cross-sectional view of FIG. 2(*b*);

FIG. 3(*b*) is a rear view of the pivoting razor in the neutral state;

FIG. 3(*c*) is a front view of the pivoting razor in the neutral state;

FIG. 3(*d*) is a side view of the pivoting razor in the neutral state;

FIG. 4(*b*) is a partial enlarged view of FIG. 3(*d*) showing the pivoting razor in the neutral state;

FIG. 4(*c*) is a partial cross-sectional view of FIG. 4(*b*);

FIG. 5(*b*) is a partial cross-sectional view showing a pivoting razor according to a fourth embodiment in a neutral state;

FIG. 5(*c*) is a partial cross-sectional view showing a pivoting razor according to a fifth embodiment in a neutral state;

FIG. 5(*d*) is a partial cross-sectional view showing a pivoting razor according to a sixth embodiment in a neutral state;

FIG. 6(*b*) is a partial cross-sectional view showing a pivoting razor according to an eighth embodiment in a neutral state;

FIG. 6(*c*) is a partial cross-sectional view showing a pivoting razor according to a ninth embodiment in a neutral state;

FIG. 7(*b*) is a rear view of the pivoting razor in the neutral state;

FIG. 7(*c*) is a front view of the pivoting razor in the neutral state;

FIG. 7(*d*) is a side view of the pivoting razor in the neutral state;

FIG. 8(*b*) is a partial enlarged view of FIG. 7(*d*) showing the pivoting razor in the neutral state;

FIG. 8(*c*) is a partial plan view of the pivoting razor in the same state;

FIG. 9(*b*) is a partial plan view of the pivoting razor in the same state;

FIG. 10(*b*) is a partial cross-sectional view of FIG. 8(*c*) showing the same pivoting razor;

FIG. 10(*c*) is a partial plan cross-sectional view showing a pivoting razor according to a modification of the tenth embodiment in a neutral state;

FIG. 11(*a*) is a partial side view showing the pivoting razor according to the tenth embodiment in a state in which the pivoting razor has been moved to incline upward;

FIG. 11(*b*) is a partial rear view of the pivoting razor in the same state;

FIG. 11(*c*) is a partial cross-sectional view of the pivoting razor as seen from the side;

FIG. 12(*a*) is a partial side view showing the pivoting razor according to the tenth embodiment in a state in which the pivoting razor was moved to incline downward;

FIG. 12(*b*) is a partial rear view of the pivoting razor in the same state;

FIG. 12(*c*) is a partial cross-sectional view of the pivoting razor as seen from the side;

FIG. 13(*b*) is a partial rear view of the pivoting razor in the same state;

FIG. 13(*c*) is a partial cross-sectional view of the pivoting razor as seen from the side;

FIG. 14(*b*) is a partial rear view of the pivoting razor in the same state; and FIG. 14(*c*) is a partial cross-sectional view of the pivoting razor.

DETAILED DESCRIPTION OF THE PREFERRED EMBODIMENTS

First, a pivoting razor according to a first embodiment of the present invention will be described referring to FIGS. 1 and 2 based on a neutral state when the pivoting razor is not being used.

Figure 1:
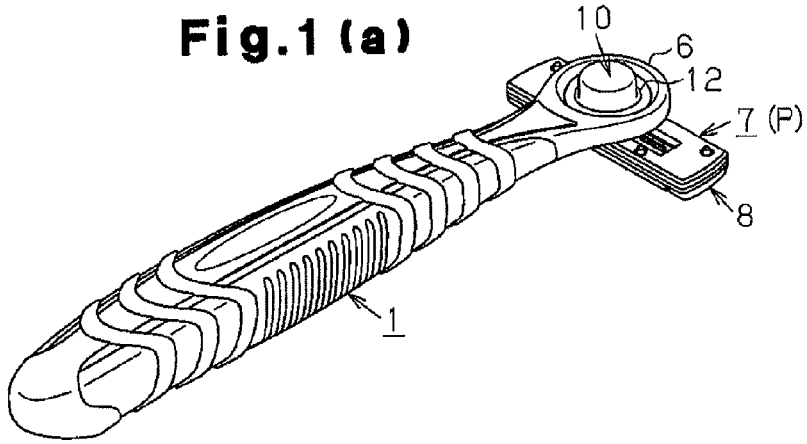
FIG. 1(*a*) is a perspective view showing a pivoting razor according to a first embodiment in a neutral state.
Figure 1:
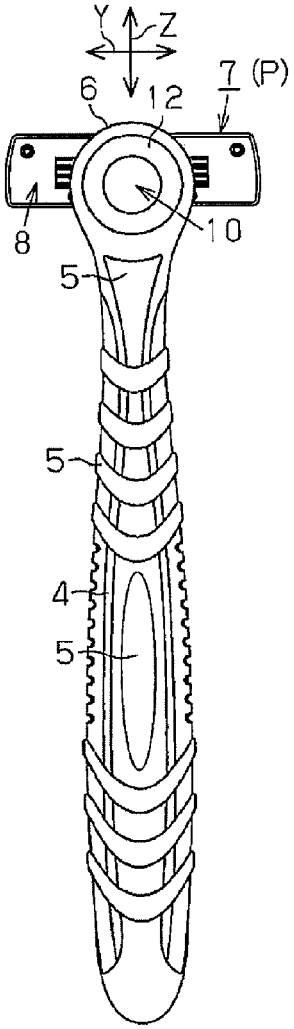
Figure 1:
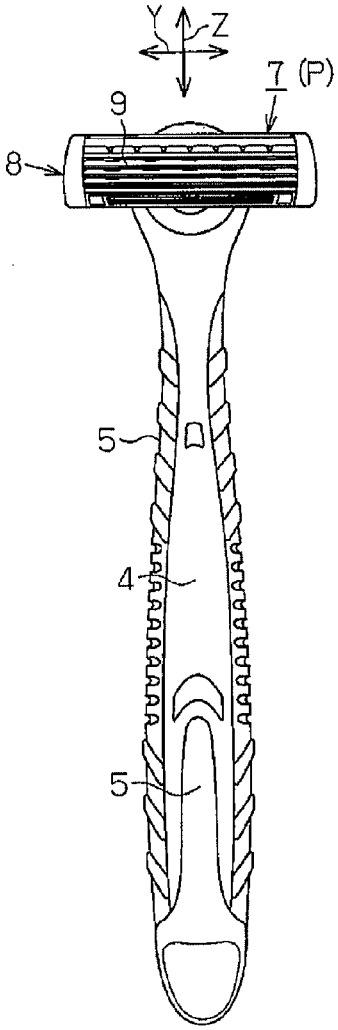
Figure 1:
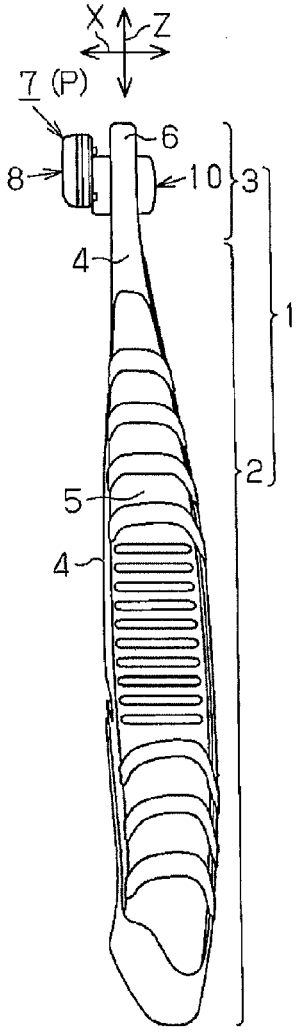

A holder 1 shown in FIG. 1 includes a grip portion 2 that is provided to extend in an elongated manner in a vertical direction Z and a head portion 3 provided at the upper end of the grip portion 2. The grip portion 2 includes a main body portion 4 that is formed of a hard plastic, and at least one finger contact portion 5 that is formed of a soft plastic and is exposed to the outer side of the main body portion 4. The head portion 3 has a support portion 6 that is formed integrally with the main body portion 4 of the grip portion 2, and is made from a hard plastic that is the same material as the main body portion 4. At least one of the main body portion 4 of the grip portion 2 and the support portion 6 of the head portion 3 may also be formed of a rigid material other than a hard plastic. Further, the finger contact portion 5 may also be formed of a flexible material other than a soft plastic.

An annular portion 6*a* that extends in an annular fashion is formed in the support portion 6. A razor head 7 shown in FIG. 1 and FIGS. 2(*a*) and 2(*b*) includes a blade-body assembly portion 8 in which a blade body 9 is mounted, and a columnar supported portion 10 that extends from the blade-body assembly portion 8 towards the support portion 6 of the head portion 3 of the holder 1. As shown in FIG. 2(*c*), the annular portion 6*a* of the support portion 6 defines a support hole 11 on the inner side. Inside the support hole 11, an elastic plate 12 (elastic portion) is located between the inner circumference of the annular portion 6*a* and the outer circumference of the supported portion 10 of the razor head 7. The outer circumference of the annular portion 6*a* of the support portion 6 protrudes further upward than the blade-body assembly portion 8 of the razor head 7 in the vertical direction Z.

The supported portion 10 includes a second connection portion 13 having a tube portion 14 (extended portion) and a bottom portion 15, and a first connection portion 16 having a first arm portion 17 and a second arm portion 18 that each protrude from a blade base 8*a* of the blade-body assembly portion 8. The first arm portion 17 and the second arm portion 18 are inserted into the inside of the tube portion 14 and are guided in only the direction of an axis 13*a* not to rotate around the axis 13*a* in the extending direction of the tube portion 14. The first arm portion 17 contacts the inside of the bottom portion 15 to restrict movement of the first connection portion 16 in a front-rear direction X. A latching hook portion 18*a* (coupling portion) is formed at a tip portion of the second arm portion 18. A latching hole 14*a* (coupling portion) is formed in the tube portion 14. The latching hook portion 18*a* is inserted into and engaged with the latching hole 14*a* to thereby prevent unwanted separation of the first connection portion 16 from the second connection portion 13. Consequently, the second connection portion 13 and the first connection portion 16 cannot be detached from each other. The tube portion 14 and the bottom portion 15 of the second connection portion 13 as well as the first arm portion 17 and the second arm portion 18 of the first connection portion 16 are formed of a hard plastic.

The elastic plate 12 is formed by placing the support portion 6 of the head portion 3 and the second connection portion 13 of the supported portion 10 of the razor head 7 inside a mold, and supplying a rubber material or other flexible material into a cavity in the mold. The elastic plate 12 has an annular elastic portion 12*a* that extends in an annular fashion along the inner circumference of the annular portion 6*a* of the support portion 6 and the outer circumference of the tube portion 14 of the second connection portion 13 inside the support hole 11. After formation of the elastic plate 12, as described in the foregoing, the blade-body assembly portion 8 is inserted into the supported portion 10 to be attached thereto. The outer circumferential portion of the annular elastic portion 12*a* comes into surface contact with the inner circumferential portion of the annular portion 6*a* of the support portion 6, and is attached thereto by heat and pressure at the time of molding. The supported portion 10 extends through the annular elastic portion 12*a* along the thickness (in the front-rear direction X) of the annular elastic portion 12*a*, and is supported by the annular elastic portion 12*a*. The inner circumferential portion of the annular elastic portion 12*a* comes into surface contact with the outer circumferential portion of the tube portion 14 of the supported portion 10, and is attached thereto by heat and pressure at the time of molding. A bending-allowing portion 19 is formed in the annular elastic portion 12*a*. The bending-allowing portion 19 has a ridge portion 20 that continuously extends in an annular fashion concentrically with the tube portion 14 at the circumference of the tube portion 14 and protrudes along the axis 13*a* in a direction away from the blade-body assembly portion 8, and a groove portion 21 that is formed on the back of the ridge portion 20. The ridge portion 20 may also protrude along the axis 13*a* in a direction approaching the blade-body assembly portion 8. The elastic plate 12 including the annular elastic portion 12*a* has a substantially uniform thickness (0.1 to 3 mm). The bending-allowing portion 19 in the annular elastic portion 12*a* of the elastic plate 12 may also be made thinner than portions other than the bending-allowing portion 19 to facilitate bending. A protruding dimension of the ridge portion 20 at the bending-allowing portion 19 is between 0.3 and 5 mm.

Figure 2A:
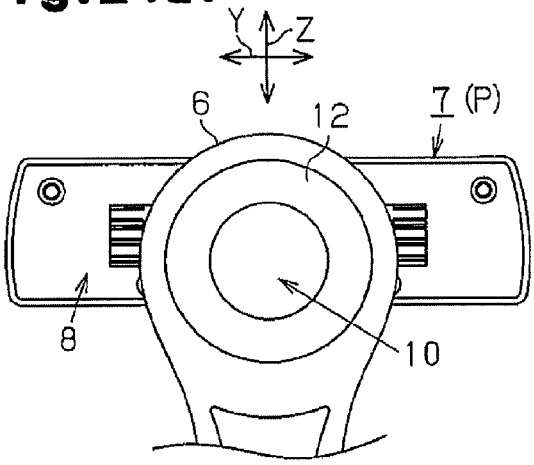
FIG. 2(*a*) is a partial enlarged view of FIG. 1(*b*), showing the pivoting razor according to the first embodiment in a neutral state.
Figure 2B:
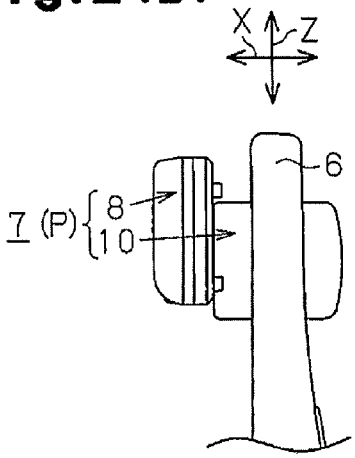
Figure 2C:
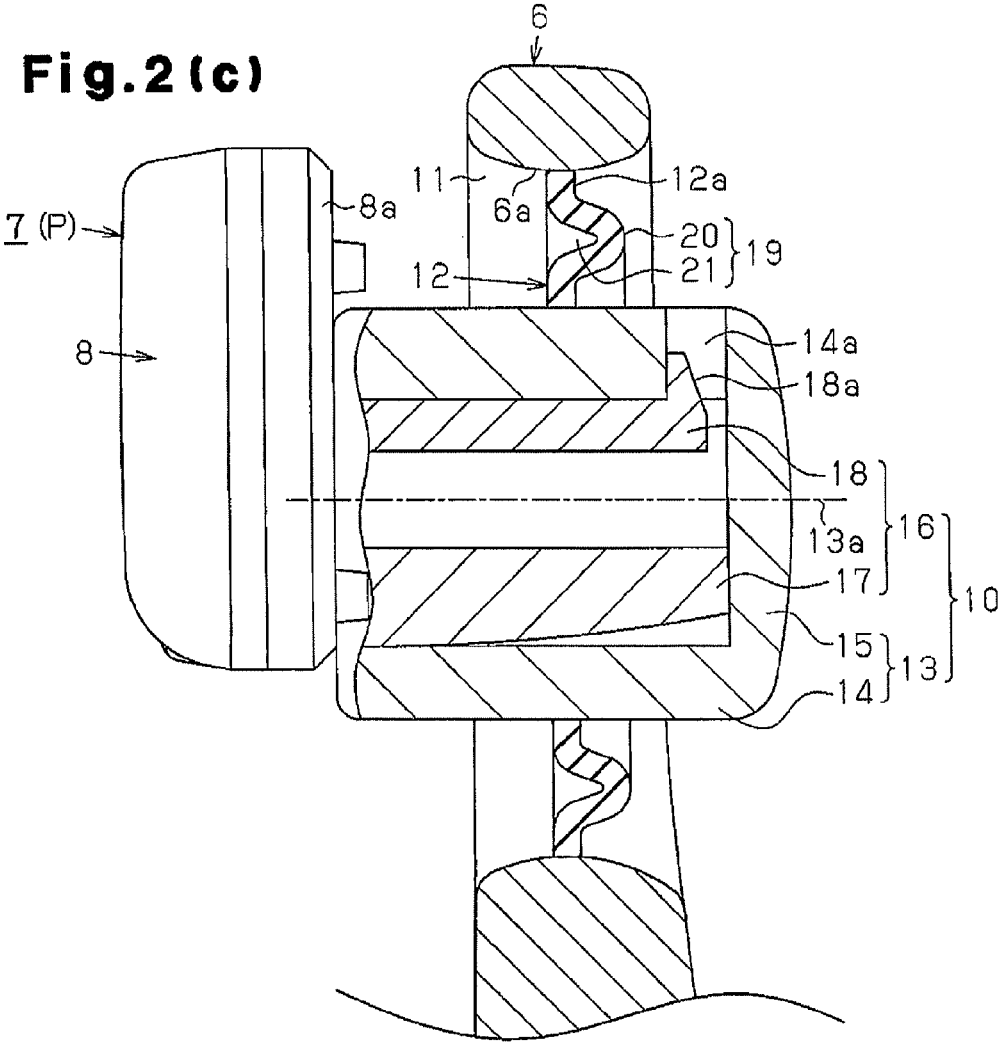
Figure 3A:
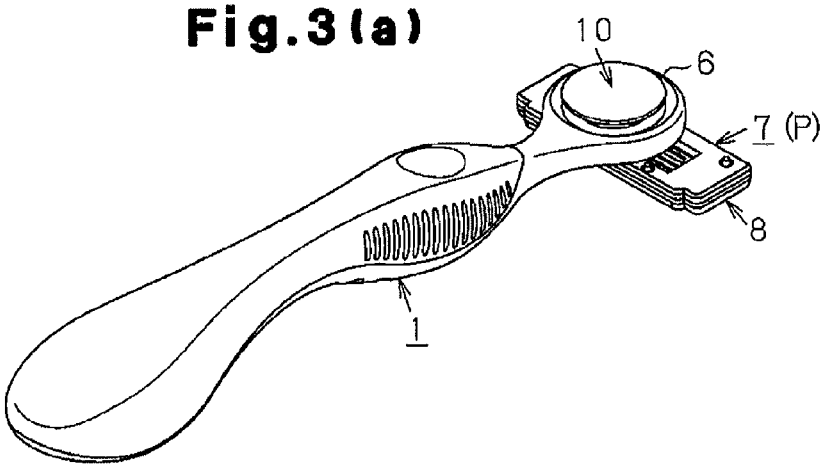
FIG. 3(*a*) is a perspective view showing a pivoting razor according to a second embodiment in a neutral state.
Figure 3B:
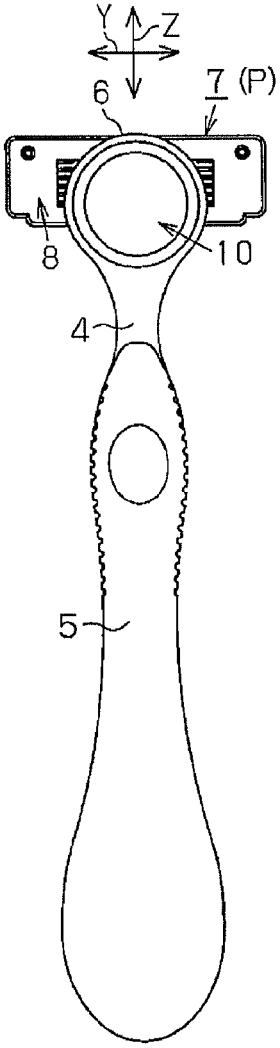
Figure 3C:
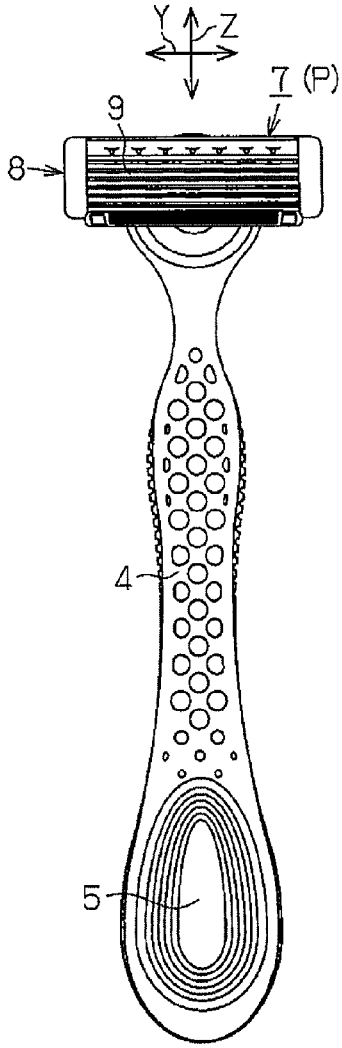
Figure 3D:
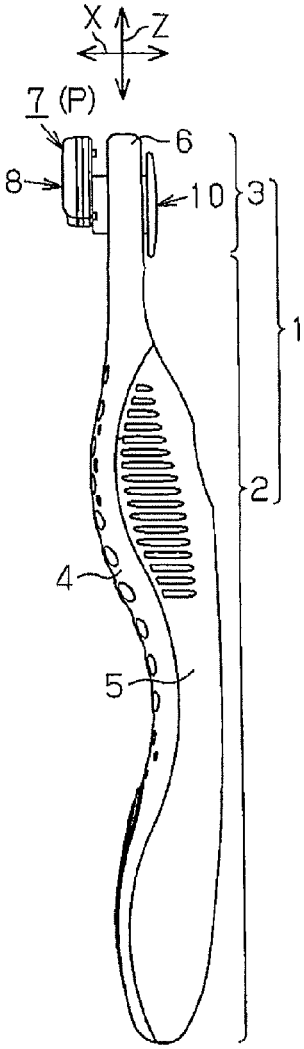

The razor head 7 is retained at a neutral position P shown in FIGS. 2(*b*) and 2(*c*) by the elastic plate 12. When force is applied at the time of use to the razor head 7 positioned at the neutral position P, the elastic plate 12 can bend towards various movement positions. For example, the elastic plate 12 can bend in the direction of the axis 13*a* of the tube portion 14 of the supported portion 10, a direction of rotation around the axis in the horizontal direction Y, a direction of rotation around the axis in the vertical direction Z, the front-rear direction X, the horizontal direction Y, the vertical direction Z, and in a direction that is a combination of the aforementioned directions. Therefore, the razor head 7 can be moved against an elastic force from the neutral position P to movement positions in three-dimensional directions.

Figure 4A:
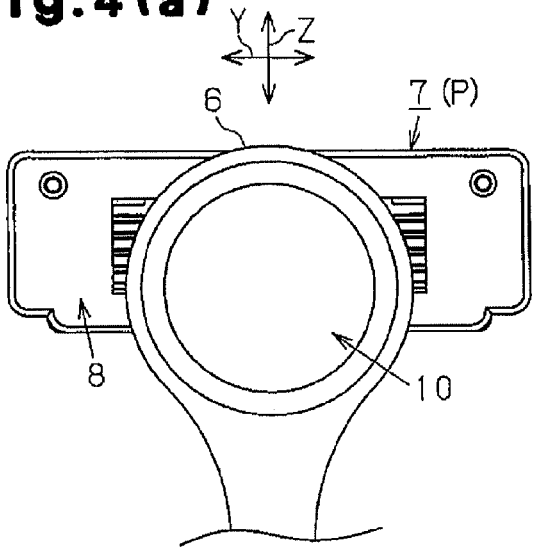
FIG. 4(*a*) is a partial enlarged view of FIG. 3(*b*), showing the pivoting razor according to the second embodiment in a neutral state.
Figure 4B:
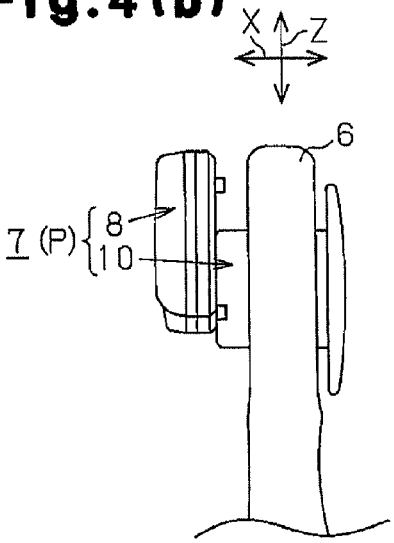
Figure 4C:
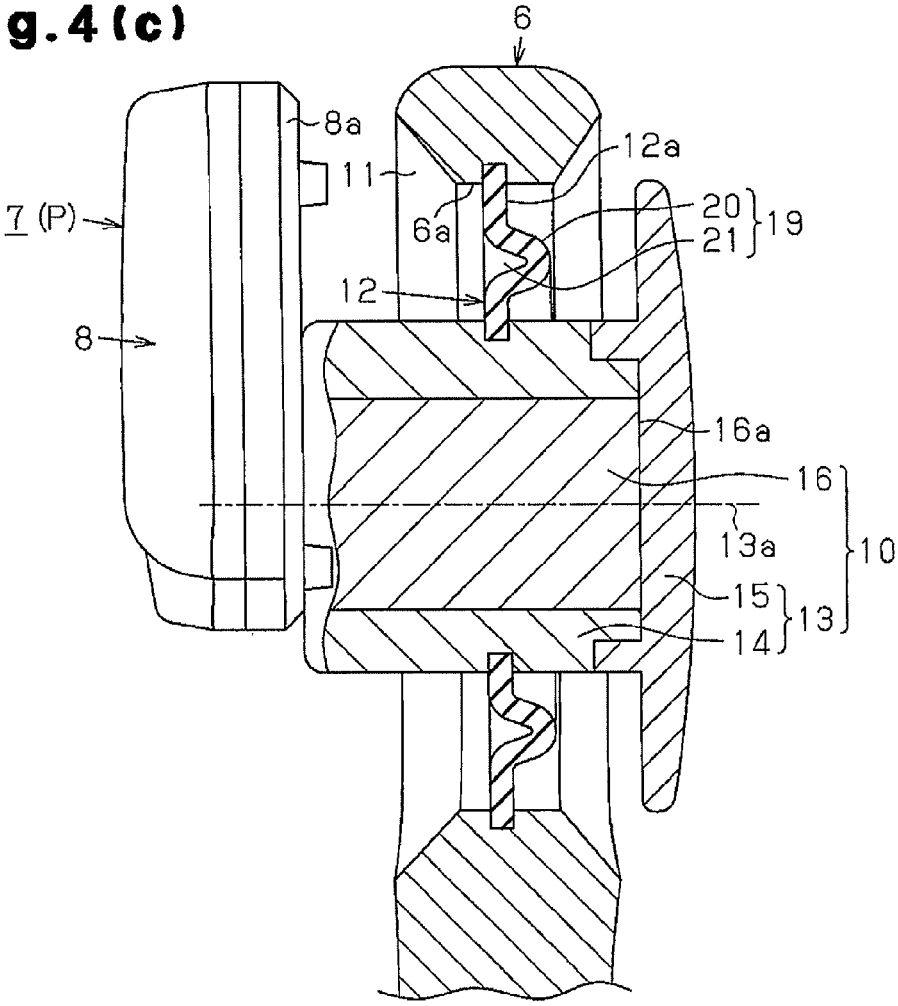
Figure 5A:
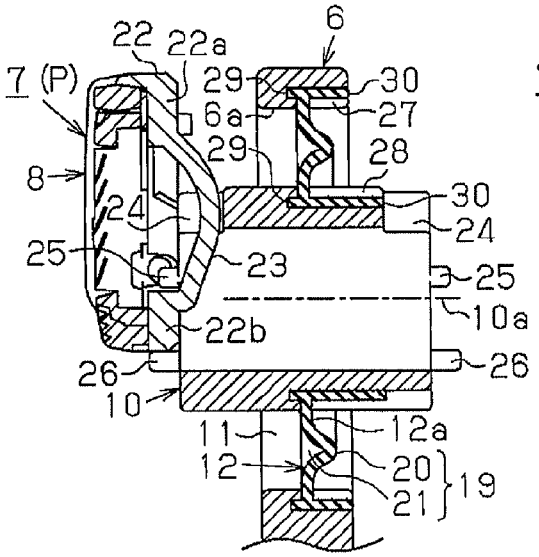
FIG. 5(*a*) is a partial cross-sectional view showing a pivoting razor according to a third embodiment in a neutral state.
Figure 5B:
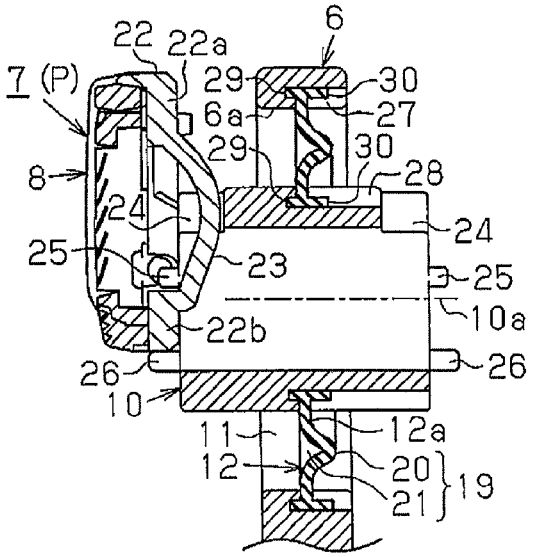
Figure 5C:
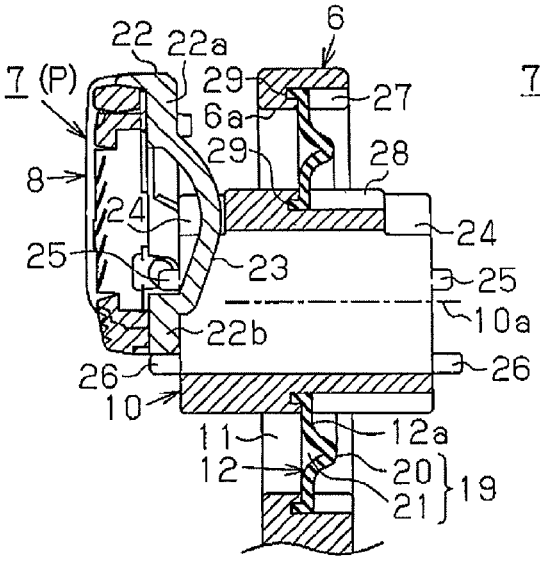
Figure 5D:
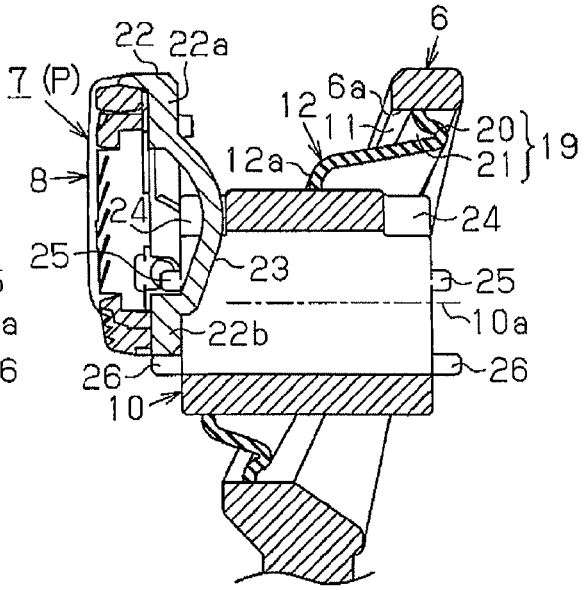

FIGS. 3 to 4 illustrate a second embodiment. FIGS. 3(*a*), 3(*b*), 3(*c*) and 3(*d*) correspond to FIGS. 1(*a*), 1(*b*), 1(*c*) and 1(*d*) of the first embodiment, and FIGS. 4(*a*), 4(*b*) and 4(*c*) correspond to FIGS. 2(*a*), 2(*b*) and 2(*c*) of the first embodiment. The second embodiment differs from the first embodiment with respect to the following points in particular.

In the second embodiment, the first connection portion 16 of the supported portion 10 of the razor head 7 is different from the first embodiment. The first connection portion 16 is inserted inside the tube portion 14 of the second connection portion 13, and is guided along only the axis 13*a* extending in the direction of the tube portion 14 not to rotate around the axis 13*a*. A thermal weld portion 16*a* (coupling portion) of the first connection portion 16 is thermally welded to the inner side of the bottom portion 15 by internal frictional heat that is generated by ultrasonic vibration. Consequently, because of the presence of the thermal weld portion 16*a*, the first connection portion 16 and the second connection portion 13 cannot be detached from each other.

In the second embodiment, the outer circumferential portion of the annular elastic portion 12*a* of the elastic plate 12 is formed to be embedded inside the annular portion 6*a* of the support portion 6, and the inner circumferential portion of the annular elastic portion 12*a* is formed to be embedded in the outer circumferential portion of the tube portion 14 of the second connection portion 13.

In the second embodiment, the tube portion 14 and the bottom portion 15 of the second connection portion 13 of the supported portion 10 of the razor head 7 are separately formed and are fitted together. The bottom portion 15 has a larger diameter than the tube portion 14. The outer circumferential portion of the bottom portion 15 protrudes outward in the radial direction from the tube portion 14, and faces the annular elastic portion 12*a* of the elastic plate 12.

FIG. 5(*a*) illustrates a third embodiment, FIG. 5(*b*) illustrates a fourth embodiment, FIG. 5(*c*) illustrates a fifth embodiment, and FIG. 5(*d*) illustrates a sixth embodiment. FIGS. 5(*a*) to 5(*d*) correspond to FIG. 2(*c*) of the first embodiment. The third to sixth embodiments differ from the first embodiment with respect to the following points in particular.

As shown in FIGS. 5(*a*) to 5(*d*), in the third to sixth embodiments the razor head 7 has the blade-body assembly portion 8 and the supported portion 10 that are separated from each other. A blade base 22 of the blade-body assembly portion 8 includes a top frame portion 22*a*, a bottom frame portion 22*b*, and a strip portion 23 that extends in an arch shape to connect the top frame portion 22*a* and the bottom frame portion 22*b*. The supported portion 10 is formed in a cylindrical shape in which the front end and rear end are open. Notches 24 (coupling portions) are formed in a top part of an outer circumferential edge portion at the front end and rear end of the supported portion 10. On the left side and the right side of the respective outer circumferential edge portions, a pair of upper protrusions 25 and a pair of lower protrusions 26 that extend in the front-rear direction, respectively, are formed below the notches 24. In FIGS. 5(*a*) to 5(*d*), at the front end of the supported portion 10, the strip portion 23 of the blade base 22 is inserted into and engaged with the notch 24. Further, the bottom frame portion 22*b* (coupling portion) of the blade base 22 is inserted between and engaged with the upper protrusion 25 and the lower protrusion 26 (coupling portion). The bottom frame portion 22*b* of the blade base 22 is thermally welded to the supported portion 10 by internal frictional heat that is generated by ultrasonic vibration. Consequently, the supported portion 10 and the blade base 22 cannot be detached from each other. Similarly, the supported portion 10 and the blade base 22 may be thermally welded together to be undetachable from each other at the rear end of the supported portion 10. In this case, the ridge portion 20 protrudes in a direction approaching the blade-body assembly portion 8.

As shown in FIGS. 5(*a*) to 5(*c*), in the third to fifth embodiments, a notch 27 is formed in an inner circumferential portion of the annular portion 6*a* of the support portion 6, and the outer circumferential portion of the annular elastic portion 12*a* of the elastic plate 12 is formed to be embedded in the notch 27. Further, a notch 28 is formed in the outer circumferential portion of the supported portion 10, and the inner circumferential portion of the annular elastic portion 12*a* is formed to be embedded in the notch 28. As shown in FIGS. 5(*a*) and 5(*b*), the outer circumferential portion and the inner circumferential portion of the elastic plate 12 of the third and fourth embodiments each include a bite portion 29 that is embedded in the notch 27, and an extended portion 30 that extends in the front-rear direction from the bite portion 29 and comes into surface contact with the corresponding one of the outer circumferential portion and inner circumferential portion of the elastic plate 12. As shown in FIG. 5(*c*), the outer circumferential portion and inner circumferential portion of the elastic plate 12 of the fifth embodiment each include only the bite portion 29, which is embedded in the notch 27.

As shown in FIG. 5(*d*), in the elastic plate 12 of the sixth embodiment, the outer circumferential portion of the annular elastic portion 12*a* is attached to come into surface contact with the inner circumferential portion of the annular portion 6*a* of the support portion 6. The inner circumferential portion of the annular elastic portion 12*a* is attached to come into surface contact with the outer circumferential portion of the supported portion 10. The elastic plate 12 of the third to fifth embodiments is linearly symmetric with respect to the axis 10*a* of the supported portion 10. That is, a plane including the outer circumferential portion of the annular elastic portion 12*a* and a plane including the inner circumferential portion of the annular elastic portion 12*a* of the elastic plate 12 of the third to fifth embodiments are perpendicular with respect to the axis 10*a*. In contrast, a plane including the outer circumferential portion of the annular elastic portion 12*a* and a plane including the inner circumferential portion of the annular elastic portion 12*a* of the elastic plate 12 of the sixth embodiment diagonally intersect with the axis 10*a* of the supported portion 10, and the elastic plate 12 is formed asymmetrically with respect to the axis 10*a*.

Figure 6B:
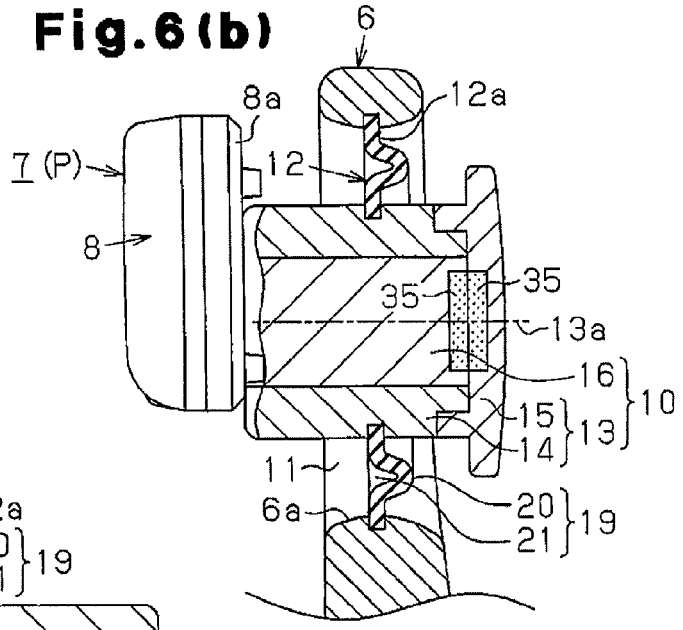
FIG. 6(*a*) is a partial cross-sectional view showing a pivoting razor according to a seventh embodiment in a neutral state.
Figure 6A:
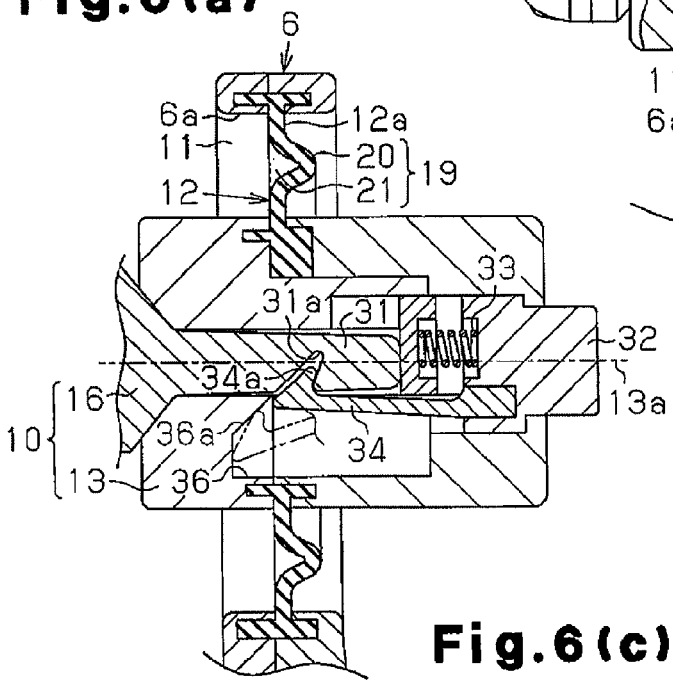
Figure 6C:
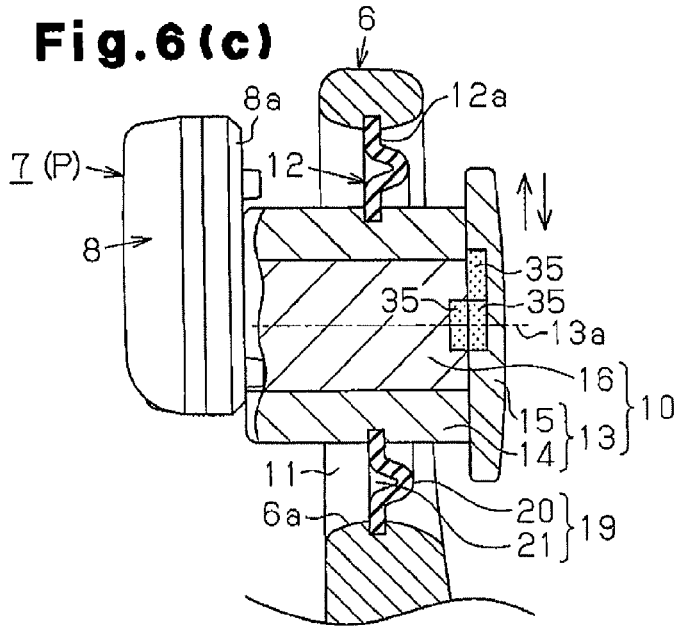
Figure 7A:
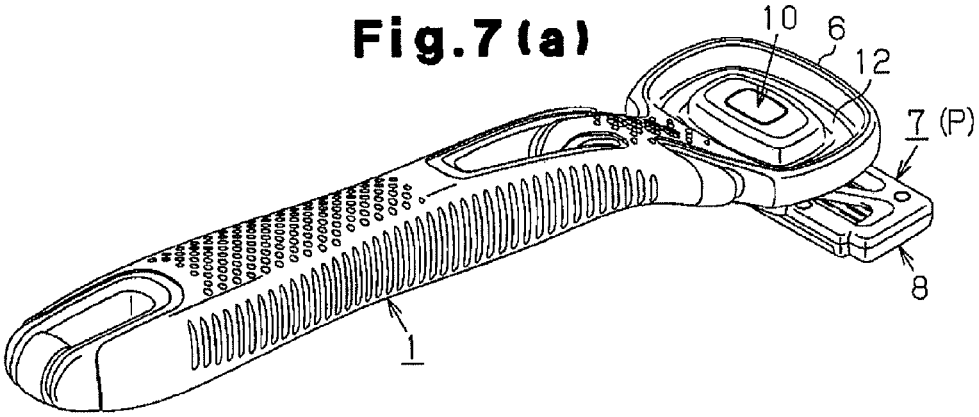
FIG. 7(*a*) is a perspective view showing a pivoting razor according to a tenth embodiment in a neutral state.
Figure 7B:
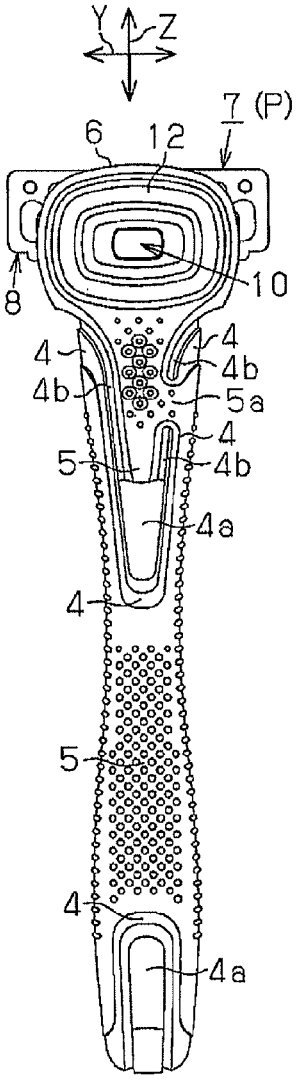
Figure 7C:
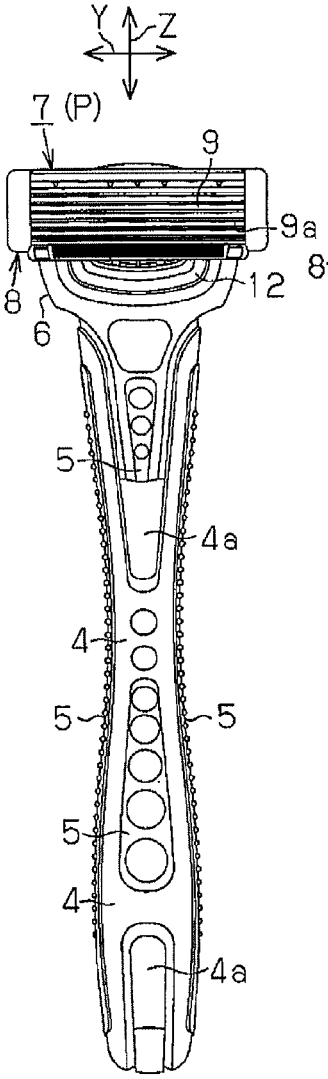
Figure 7D:
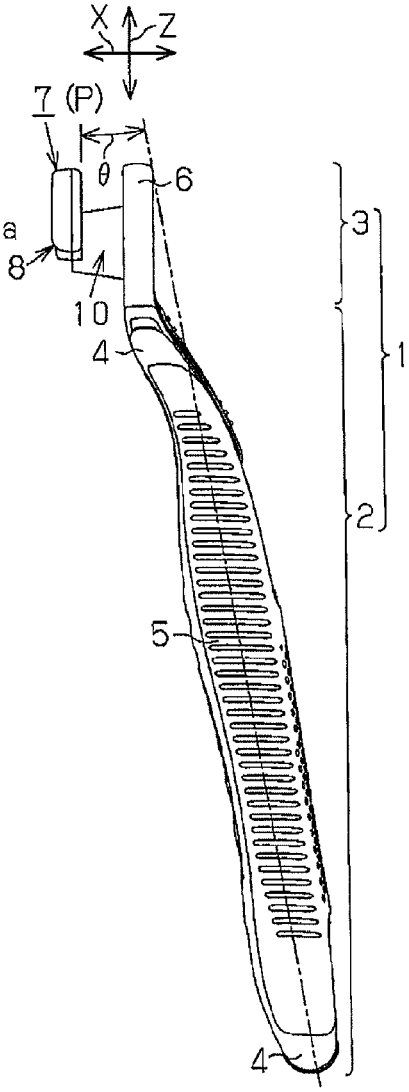

FIG. 6(*a*) illustrates a seventh embodiment, FIG. 6(*b*) illustrates an eighth embodiment, and FIG. 6(*c*) illustrates a ninth embodiment. FIGS. 6(*a*) to 6(*c*) correspond to FIG. 2(*c*) of the first embodiment. The seventh to ninth embodiments differ from the first embodiment with respect to the following points in particular.

As shown in FIG. 6(*a*), the support portion 6 and the second connection portion 13 of the seventh embodiment are each formed from two components. The elastic plate 12 is formed separately from the support portion 6 and the second connection portion 13. The elastic plate 12 is sandwiched between the two components of the support portion 6 and between the two components of the second connection portion 13. The first connection portion 16 includes a latching arm 31 that is inserted into the second connection portion 13. The latching arm 31 has a latching recess 31*a* that acts as a coupling portion. The second connection portion 13 includes an operation button 32 that acts as an operation portion. An operation spring 33 is inserted between the operation button 32 and the latching arm 31 of the first connection portion 16. A latching arm 34 is attached in a cantilever fashion to the operation button 32. The latching arm 34 has a latching protrusion 34*a* that acts as a coupling portion at the free end thereof. The latching protrusion 34*a* of the latching arm 34 is inserted into and engaged with the latching recess 31*a* of the latching arm 31, thereby preventing the second connection portion 13 and the first connection portion 16 from separating from each other. The second connection portion 13 includes a recess 36 at a position facing the latching recess 31*a*. The recess 36 includes an inclined face 36*a* that guides the latching arm 34 to cancel a latched state of the latching protrusion 34*a* of the latching arm 34 with respect to the latching recess 31*a* of the first connection portion 16. When the operation button 32 is pushed against the elastic force of the operation spring 33, the latching protrusion 34*a* of the latching arm 34 is guided by the inclined face 36*a* of the recess 36, and the latching arm 34 bends to thereby cancel the latched state of the latching recess 31*a* and the latching protrusion 34*a*. As a result, the latching arm 31 of the first connection portion 16 is caused to separate from the second connection portion 13 by the pressing force of the operation button 32 and the elastic force of the operation spring 33. Thus, in the seventh embodiment, the second connection portion 13 and the first connection portion 16 are attachable and detachable with respect to each other.

The supported portion 10 of the razor head 7 of the eighth embodiment includes the same first connection portion 16 and second connection portion 13 as the second embodiment. As shown in FIG. 6(*b*), the first connection portion 16 is inserted into the inside of the tube portion 14 of the second connection portion 13, and the bottom portion 15 of the second connection portion 13 has a diameter that is larger than the tube portion 14. Magnets 35 are embedded at positions at which the bottom portion 15 of the second connection portion 13 and the first connection portion 16 face each other. The two magnets 35 are adapted to attach to each other. The first connection portion 16 is inserted inside the tube portion 14, and is guided in only the direction of the axis 13*a* in the extending direction of the tube portion 14, not to rotate around the axis 13*a*. If the blade-body assembly portion 8 of the razor head 7 is pulled against the magnetic force of the magnets 35 (coupling portion), the blade-body assembly portion 8 can cause the first connection portion 16 to separate from the second connection portion 13 along the direction of the axis 13*a*. When the first connection portion 16 is inserted into the second connection portion 13, the first connection portion 16 is guided along the direction of the axis 13*a*, and can be attached to the second connection portion 13 by the magnetic force of the magnets 35. Consequently, the first connection portion 16 and the second connection portion 13 are attachable and detachable with respect to each other. In addition, the elastic plate 12 of the eighth embodiment is the same as the elastic plate of the second embodiment. In a case where the blade-body assembly portion 8 of the razor head 7 is covered with a cap (not shown), the first connection portion 16 and the second connection portion 13 can be separated by pulling the cap together with the blade-body assembly portion 8. When inserting the blade-body assembly portion 8 into a replacement blade case (not shown), the first connection portion 16 and the second connection portion 13 can be separated by pulling the replacement blade case together with the blade-body assembly portion 8.

As shown in FIG. 6(*c*), the ninth embodiment has a different second connection portion 13 from the eighth embodiment. The bottom portion 15 can slide in the direction perpendicular to the extending direction of the tube portion 14, and a first magnet and a second magnet 35 that exhibit different polarities from each other are embedded in the bottom portion 15 in the sliding direction of the bottom portion 15. The bottom portion 15 is urged by a spring (not shown) towards a bottom neutral position along the sliding direction of the bottom portion 15. At the bottom neutral position, the first magnet 35 of the bottom portion 15 is located at a position facing the magnet 35 of the first connection portion 16 and is configured to attach to the magnet 35 of the first connection portion 16. Accordingly, at the bottom neutral position, similarly to the eighth embodiment, the first connection portion 16 can attach to the second connection portion 13. When the bottom portion 15 is slid from the bottom neutral position against the elastic force of the spring with respect to the tube portion 14 by, for example, a finger, the second magnet 35 is moved to the position facing the magnet 35 of the first connection portion 16, and the first connection portion 16 and the second connection portion 13 can be separated by a repulsive force between the second magnet 35 and the magnet 35 of the first connection portion 16. When the finger is released from the bottom portion 15, the bottom portion 15 returns to the bottom neutral position by means of the elastic force of the spring. Consequently, the first connection portion 16 and the second connection portion 13 are attachable and detachable with respect to each other. A configuration may also be adopted in which the spring is omitted, and the bottom portion 15 is slid with respect to the tube portion 14 against a frictional resistance that arises between the tube portion 14 and the bottom portion 15.

A configuration may also be adopted so that a magnetic attachment force arises between the magnet 35 and a magnetic body such as iron.

Next, referring to FIGS. 7 to 14, a pivoting razor according to a tenth embodiment and modifications of the present invention will be described based on a neutral state in which the pivoting razor is not in use.

A holder 1 shown in FIG. 7 includes a grip portion 2 that is provided to extend in an elongated manner in a vertical direction Z, and a head portion 3 provided at an upper end of the grip portion 2. The grip portion 2 includes a main body portion 4 that is formed of a hard plastic, and at least one finger contact portion 5 that is formed of a soft plastic or a rubber material or a flexible material other than a rubber material and is exposed to the outside of the main body portion 4. The head portion 3 has a support portion 6 that is formed integrally with the main body portion 4 of the grip portion 2, and is made from a hard plastic that is the same material as the main body portion 4.

Figure 8A:
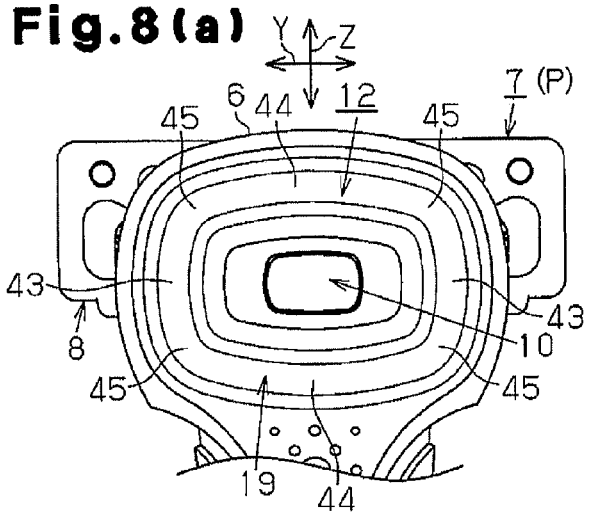
FIG. 8(*a*) is a partial enlarged view of FIG. 7(*b*), showing the pivoting razor according to the tenth embodiment in a neutral state.
Figure 8B:
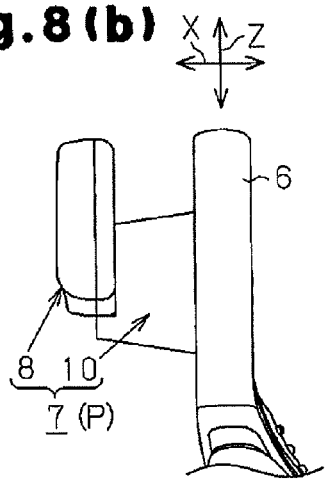
Figure 8C:
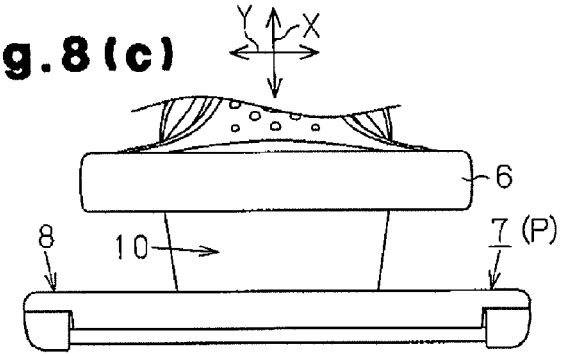
Figures 10A, 10B, 10C:
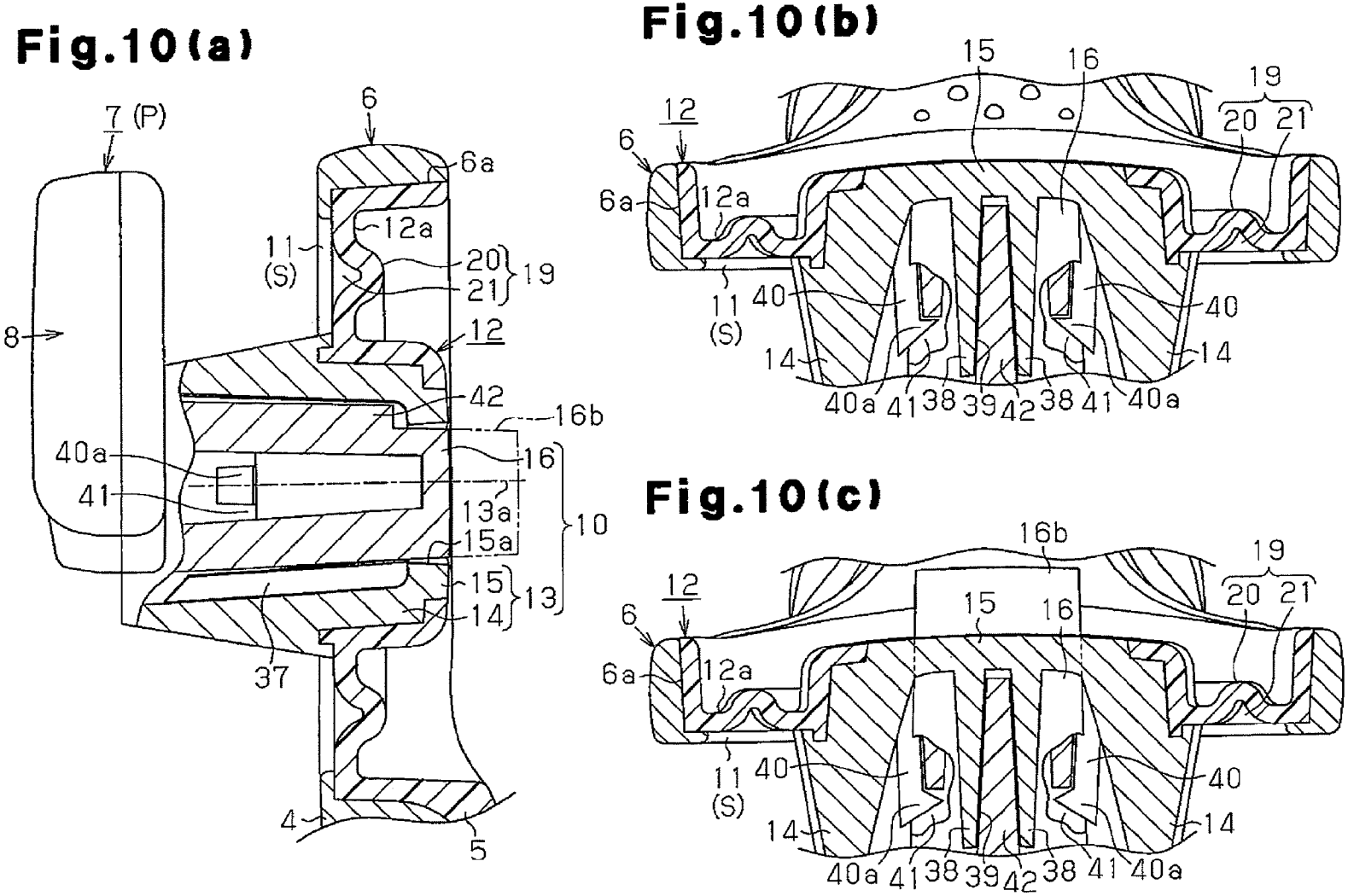
FIG. 10(*a*) is a partial cross-sectional view of FIG. 8(*b*), showing a pivoting razor according to the tenth embodiment in a neutral state.

The support portion 6 shown in FIGS. 7 and 8 and FIGS. 10(*a*) and 10(*b*) includes an annular portion 6*a* that is formed in an substantially closed rectangular shape by an upper edge portion, a lower edge portion, a left edge portion, and a right edge portion. The upper edge portion, lower edge portion, left edge portion and right edge portion bulge gradually to protrude towards the outside of the annular portion 6*a*. A corner between the upper edge portion and left edge portion, a corner between the upper edge portion and right edge portion, a corner between the lower edge portion and left edge portion, and a corner between the lower edge portion and right edge portion are smoothly connected to the upper edge portion, lower edge portion, left edge portion and right edge portion by gradual curves. The maximum distance between the left edge portion and right edge portion in the horizontal direction Y is set to approximately 27.5 mm, and the maximum distance between the upper edge portion and lower edge portion in the vertical direction Z is set to approximately 21.0 mm.

The razor head 7 shown in FIGS. 7 and 8 has a blade-body assembly portion 8 in which a blade body 9 is mounted, and a supported portion 10 that extends from the blade-body assembly portion 8 towards the support portion 6 of the head portion 3. As shown in FIGS. 10(*a*) and 10(*b*), the annular portion 6*a* of the support portion 6 defines a support hole 11 on the inner side. Inside the support hole 11, an elastic plate 12 (elastic portion) is located between the inner circumference of the annular portion 6*a* and the outer circumference of the supported portion 10 of the razor head 7. An upper part of the outer circumferential portion of the annular portion 6*a* of the support portion 6 protrudes further upward than the blade-body assembly portion 8 of the razor head 7 in the vertical direction Z.

The supported portion 10 of the razor head 7 includes a second connection portion 13 having a tube portion 14 (extended portion) and a bottom portion 15 (end portion), and a first connection portion 16 that protrudes from a blade base 8*a* of the blade-body assembly portion 8. The tube portion 14 of the second connection portion 13 is a quadrangular tubular shape, and is composed of an upper wall portion, a lower wall portion, a left wall portion, and a right wall portion. The first connection portion 16 is a closed-end quadrangular tubular shape and is composed of an upper wall portion, a lower wall portion, a left wall portion, a right wall portion and a bottom portion (end portion). The bottom portion 15 of the second connection portion 13 has an opening 15*a*. A connecting hole 37 that opens to the front and rear is formed inside the second connection portion 13. In the connecting hole 37, on the inner side of the upper wall portion of the tube portion 14 are formed a left-side guiding ridge 38 and a right-side guiding ridge 38 that extend in the front-rear direction X towards the blade-body assembly portion 8 from the opening 15*a* of the bottom portion 15. A positioning groove 39 is formed between the left-side guiding ridge 38 and right-side guiding ridge 38. Further, a cantilever-like left-side latching arm portion 40 and right-side latching arm portion 40 that extend in the front-rear direction X towards the blade-body assembly portion 8 from the opening 15*a* are formed in the bottom portion 15. A left-side latching hole 41 and a right-side latching hole 41 (latching recess, coupling portion) are formed in the left wall portion and right wall portion of the first connection portion 16. A positioning ridge 42 that extends in the front-rear direction X is formed on the outside of the upper wall portion of the first connection portion 16. The length in the horizontal direction Y of the outer side of the upper wall portion and lower wall portion of the tube portion 14 of the second connection portion 13 is set to approximately 17.0 mm. The length in the vertical direction Z of the outer side of the left wall portion and the right wall portion of the tube portion 14 of the second connection portion 13 is set to approximately 10.5 mm.

The first connection portion 16 is inserted into the connecting hole 37 of the second connection portion 13. In the inserted state, the positioning ridge 42 (coupling portion) of the first connection portion 16 is inserted into the positioning groove 39 (coupling portion) of the second connection portion 13. The first connection portion 16 is guided in only the direction of the axis 13*a* and not to rotate around the axis 13*a* in the extending direction of the tube portion 14, and inserted into the connecting hole 37 (coupling portion) of the second connection portion 13. The bottom portion of the first connection portion 16 contacts the bottom portion 15 of the second connection portion 13 to restrict rearward movement in the front-rear direction X of the first connection portion 16. The bottom portion of the first connection portion 16 is exposed at the opening 15*a* of the bottom portion 15, and is substantially flush with the bottom portion 15. Each of the left-side latching arm portion 40 and right-side latching arm portion 40 (coupling portions) of the second connection portion 13 includes a latching hook portion 40*a* (latching protrusion) at a lower end. The left-side latching arm portion 40 and the right-side latching arm portion 40 of the second connection portion 13 are inserted into the left-side latching hole 41 and right-side latching hole 41 of the first connection portion 16, respectively, and the respective latching hook portions 40*a* act to prevent inadvertent separation of the first connection portion 16 from the second connection portion 13. Therefore, the first connection portion 16 and the second connection portion 13 are undetachable from each other. The tube portion 14 and the bottom portion 15 of the second connection portion 13, and the left-side latching arm portion 40 and right-side latching arm portion 40 of the second connection portion 13 are formed of a hard plastic.

The elastic plate 12 is formed by placing the support portion 6 of the head portion 3 and the second connection portion 13 of the supported portion 10 of the razor head 7 inside a mold, and supplying the same material as that of the finger contact portion 5 (a soft plastic, a rubber material, or a flexible material other than rubber material) into a cavity in the mold. The elastic plate 12 has an annular elastic portion 12*a* that extends in an annular fashion along the inner circumference of the annular portion 6*a* of the support portion 6 and the outer circumference of the tube portion 14 of the second connection portion 13 inside the support hole 11. The grip portion 2 of the holder 1 includes a main body portion 4 that is formed integrally with the support portion 6 of the head portion 3, and at least one finger contact portion 5 that is formed integrally with the elastic plate 12 of the head portion 3 and is exposed to the outer side of the main body portion 4. The finger contact portion 5 has asperities of various shapes that are formed for at least one purpose among the purposes of providing the finger contact portion 5 with a non-slip function and improving the feel of the finger contact portion 5. For example, the elastic plate 12 and the finger contact portion 5 are made from styrenic thermoplastic elastomer and have a hardness within a range of 20 Shore A to 60 Shore A. As shown in FIG. 7(*b*), since the finger contact portion 5 is exposed to have left-right asymmetry on the back face of the grip portion 2 that adjoins the head portion 3, the left side and the right side on the back face of the grip portion 2 are different from each other. The main body portion 4 has a groove portion 4*b* on each of the left side and the right side. The groove portion 4*b* on the left side extends continuously, and the groove portion 4*b* on the right side is interrupted at a position that is partway along the groove portion 4*b*. A finger contact portion 5*a* that is formed from elastomer is located at the portion at which the groove portion 4*b* is interrupted on the right side, and therefore when a finger contacts that portion the ball of the finger comes into surface contact with the finger contact portion 5*a*, and the finger contact portion 5*a* acts to prevent the finger from slipping. Further, the left side of the main body portion 4 that has the groove portion 4*b* that extends continuously is slippery. Two through-holes 4*a* are formed in the upper portion and lower portion of the main body portion 4 of the holder 1. Each of the through-holes 4*a* can be utilized as a hanging hole for hanging the pivoting razor on a suspension hook. One part of a finger contact portion 5 that is made of a soft plastic is exposed in the through-hole 4*a* on the upper side.

After molding of the elastic plate 12, as described in the foregoing, the blade-body assembly portion 8 is inserted into the supported portion 10 to be attached thereto. The outer circumferential portion of the annular elastic portion 12*a* comes into surface contact with the inner circumferential portion of the annular portion 6*a* of the support portion 6, and is attached thereto by heat and pressure at the time of molding. The supported portion 10 extends through the annular elastic portion 12*a* along the thickness (in the front-rear direction X) of the annular elastic portion 12*a*, and is supported by the annular elastic portion 12*a*. The inner circumferential portion of the annular elastic portion 12*a* comes into surface contact with the outer circumferential portion of the tube portion 14 of the supported portion 10, and is attached thereto by heat and pressure at the time of molding. A bending-allowing portion 19 is formed in the annular elastic portion 12*a*. The bending-allowing portion 19 has a ridge portion 20 that continuously extends in an annular fashion concentrically with the tube portion 14 on the outer side of the tube portion 14 and protrudes along the axis 13*a* in a direction away from the blade-body assembly portion 8, and a groove portion 21 that is formed on the back the ridge portion 20. An inner-side region S is defined between the annular portion 6*a* of the support portion 6 and the supported portion 10 of the razor head 7 that is a region between a flat surface including the inner circumferential edge at the front of the annular portion 6*a* and a flat surface including the inner circumferential edge at the rear thereof. The elastic plate 12 is located in the inner-side region S. The bottom portion 15 of the second connection portion 13 and the bottom portion of the first connection portion 16 of the supported portion 10 of the razor head 7 are located in the inner-side region S of the support hole 11 at positions that are more rearward than the elastic plate 12.

Although the ridge portion 20 protrudes along the axis 13*a* in a direction away from the blade-body assembly portion 8, the ridge portion 20 may protrude along the axis 13*a* in a direction approaching the blade-body assembly portion 8. The elastic plate 12 including the annular elastic portion 12*a* has a substantially uniform thickness (0.1 to 3 mm). The bending-allowing portion 19 in the annular elastic portion 12*a* of the elastic plate 12 may also be made thinner than portions other than the bending-allowing portion 19 to facilitate bending. A protruding dimension of the ridge portion 20 at the bending-allowing portion 19 is between 0.3 and 5 mm.

The bending-allowing portion 19 of the elastic plate 12 includes: a left-side bending-allowing portion 43 and a right-side bending-allowing portion 43 that face each other in the horizontal direction Y; an upper-side bending-allowing portion 44 and a lower-side bending-allowing portion 44 that face each other in the vertical direction Z; and four corner bending-allowing portions 45 that are formed at four corners between the left-side bending-allowing portion 43, the right-side bending-allowing portion 43, the upper-side bending-allowing portion 44, and the lower-side bending-allowing portion 44. The inner circumferential shape of the annular portion 6*a* of the support portion 6 and the outer circumferential shape of the second connection portion 13 of the supported portion 10 have a substantially similar shape in the support hole 11. The distance between the upper edge portion of the support portion 6 and the upper wall portion of the second connection portion 13, the distance between the lower edge portion of the support portion 6 and the lower wall portion of the second connection portion 13, the distance between the left edge portion of the support portion 6 and the left wall portion of the second connection portion 13, and the distance between the right edge portion of the support portion 6 and the right wall portion of the second connection portion 13 are set to be substantially equal to each other. The ridge portions 20 and groove portions 21 of the respective bending-allowing portions 43, 44, and 45 are arranged to be adjacent to each other along an edge portion of the support portion 6 and a wall portion of the second connection portion 13 at a position that is substantially midway between the edge portion of the support portion 6 and the wall portion of the second connection portion 13.

The width in the horizontal direction Y and the vertical direction Z of the elastic plate 12 between the support portion 6 and the supported portion 10 is set to approximately 5.0 mm.

The deformation resistance degrees (degree of elasticity), which indicate the degree of difficulty of deformation, of the bending-allowing portions 43, 44, and 45 of the elastic plate 12 are different from each other. For example, the corner bending-allowing portions 45 are shorter than the left-side bending-allowing portion 43, the right-side bending-allowing portion 43, the upper-side bending-allowing portion 44, and the lower-side bending-allowing portion 44. The corner bending-allowing portions 45 curve to act as supporting points of the bending-allowing portions 43 and 44 at the four corners between the bending-allowing portions 43 and 44. Consequently, the deformation resistance degree of the corner bending-allowing portions 45 is higher than the deformation resistance degree of the left and right bending-allowing portions 43 and the deformation resistance degree of the upper and lower bending-allowing portions 44. More specifically, the corner bending-allowing portions 45 are more difficult to deform than the left and right bending-allowing portions 43 and upper and lower bending-allowing portions 44. Further, the left-side bending-allowing portion 43 and the right-side bending-allowing portion 43 have the same length as each other, and hence have the same deformation resistance degree as each other. The upper-side bending-allowing portion 44 and the lower-side bending-allowing portion 44 have the same length as each other, and hence have the same deformation resistance degree as each other.

Next, a pivoting action when using the pivoting razor is described.

When the razor head 7 is not being used, the razor head 7 is retained at a neutral position P shown in FIGS. 8(*a*), 8(*b*) and 8(*c*) and 10(*a*) by the elastic plate 12. In the neutral position P, as shown in FIG. 7(*d*), an angle θ of the skin contacting surface of the razor head 7 is set to approximately 10 degrees with respect to the extending direction of the holder 1. Further, in the neutral position P, the bottom portion 15 of the second connection portion 13 of the supported portion 10 of the razor head 7 and the bottom portion of the first connection portion 16 are arranged within the inner-side region S of the support hole 11 at a position that is more rearward than the elastic plate 12. At a time of use, when a force is applied to the blade-body assembly portion 8 of the razor head 7 located at the neutral position P, the blade-body assembly portion 8 and the supported portion 10 of the razor head 7 move in an integrated manner and press the elastic plate 12. The elastic plate 12 can bend in the direction of various movement positions. For example, the elastic plate 12 can bend in the direction of the axis 13*a* of the tube portion 14 of the supported portion 10, a direction of rotation around the axis in the horizontal direction Y, a direction of rotation around the axis in the vertical direction Z, the front-rear direction X, the horizontal direction Y, the vertical direction Z, and in a direction that is a combination of the aforementioned directions. Therefore, the razor head 7 can be moved against an elastic force from the neutral position p to movement positions in three-dimensional directions.

Figure 14A:
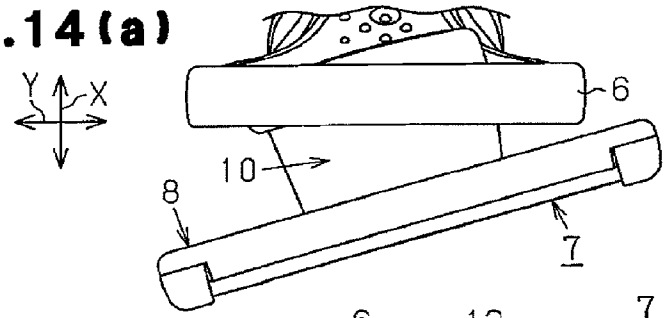
FIG. 14(*a*) is a partial plan view showing the pivoting razor according to the tenth embodiment in a state in which the pivoting razor was moved to incline in the horizontal direction.
Figure 14B:
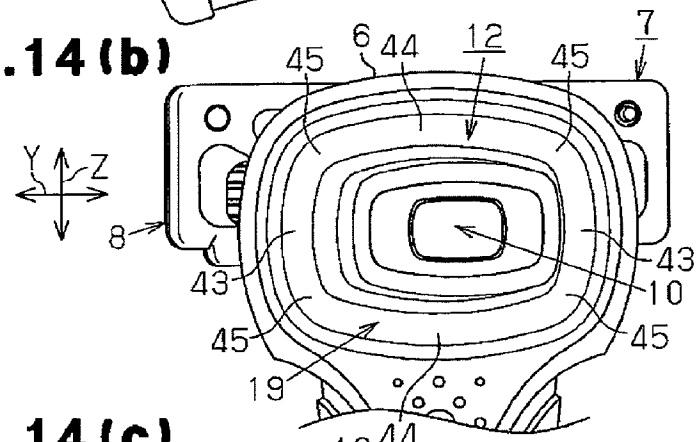
Figure 14C:
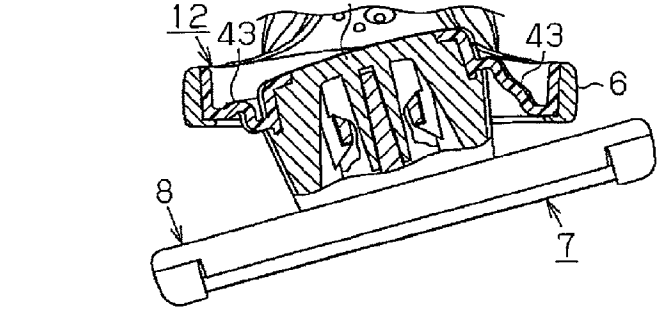
Figure 13A:
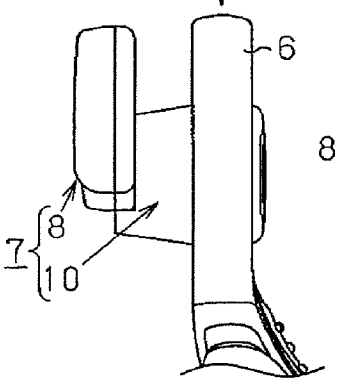
FIG. 13(*a*) is a partial side view showing the pivoting razor according to the tenth embodiment in a state in which the pivoting razor was pressed rearward.
Figure 13C:
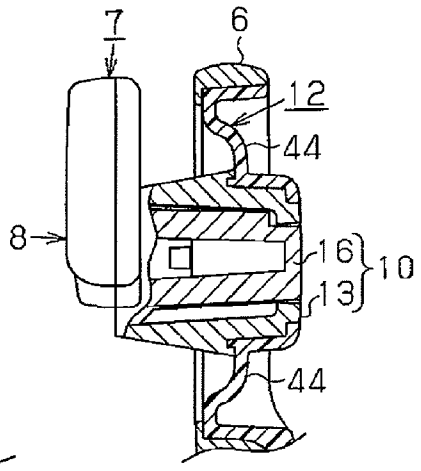
Figure 13B:
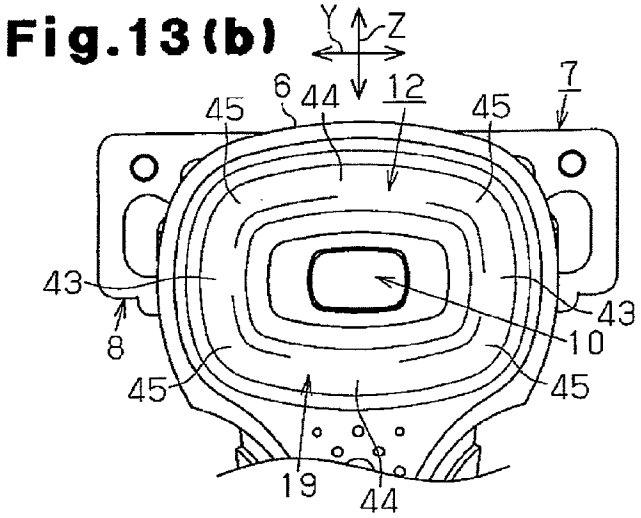

For example, when the razor head 7 moves to incline upward as shown in FIG. 11, and when the razor head 7 moves to incline downward as shown in FIG. 12, mainly the upper-side bending-allowing portion 44 and lower-side bending-allowing portion 44 change shape together. Further, for example, when the razor head 7 is pushed rearward as shown in FIG. 13, mainly the upper and lower bending-allowing portions 44 and the left and right bending-allowing portions 43 change shape together. Further, for example, when the razor head 7 moves to incline towards the right direction as shown in FIG. 14 or when the razor head 7 moves to incline towards the left direction (not shown), mainly the left-side bending-allowing portion 43 and the right-side bending-allowing portion 43 change shape together. In these cases, it is more difficult for the corner bending-allowing portions 45 to change shape than the upper and lower bending-allowing portions 44 and left and right bending-allowing portions 43. The form of the bending-allowing portions 43, 44, and 45 changes to a form that is more difficult to change shape as a change in the shape of the bending-allowing portions 43, 44, and 45 proceeds. Therefore, the deformation resistance degree of the bending-allowing portions 43, 44, and 45 at a movement position is higher than the deformation resistance degree of the bending-allowing portions 43, 44, and 45 at the neutral position P. For example, the deformation resistance degree of the bending-allowing portions 43, 44, and 45 increases as the razor head 7 moves from the neutral position P to a movement position. The razor head 7 can move to incline to a maximum of approximately 30 degrees (approximately 40 degrees with respect to the extending direction of the holder 1) upward from the neutral position P. The razor head 7 can move to incline to a maximum of approximately 30 degrees downward from the neutral position P. The razor head 7 can move to incline to a maximum of approximately 25 degrees in the horizontal direction from the neutral position P. The razor head 7 can move between 0.1 and 5.0 mm rearward from the neutral position P, preferably between 0.1 and 2.0 mm.

Pivoting of the razor head 7 can be intentionally suppressed by the user by pressing at least one of the supported portion 10 and the elastic plate 12 from behind with a finger.

Figure 9A:
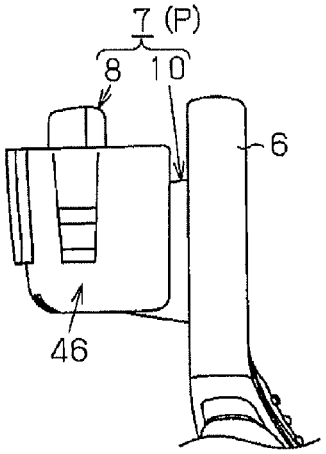
FIG. 9(*a*) is a partial side view showing the pivoting razor according to the tenth embodiment in a state in which a cap is attached to a razor head thereof in a neutral position.
Figure 9B:
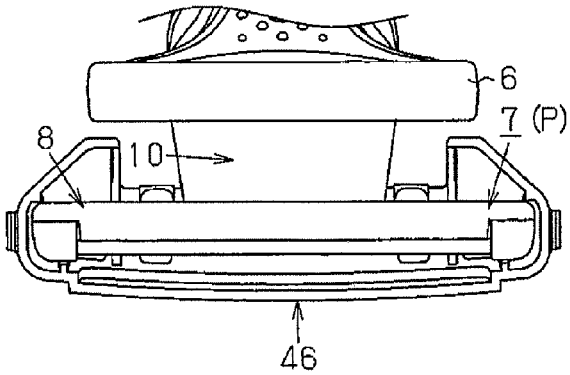

As shown in FIG. 9, in a case where the razor head 7 is covered with a cap 46 also, the razor head 7 can move within the range of a gap between the cap 46 and the support portion 6 of the head portion 3. The moving range of the razor head 7 that is covered by the cap 46 is smaller than the moving range thereof when the razor head 7 is not covered by the cap 46. Although not illustrated in the drawings, the cap 46 can also be made to cover the razor head 7 from the upper side thereof.

According to a modification of the tenth embodiment that is shown in FIG. 10(*c*), the bottom portion of the first connection portion 16 that is exposed at the opening 15*a* of the bottom portion 15 of the second connection portion 13 protrudes more rearward than the bottom portion 15 of the second connection portion 13, as shown by a broken line in which a long dash alternates with a pair of short dashes in FIG. 10(*a*). In this case, the bottom portion of the first connection portion 16 acts as an operation portion 16*b*. The form of the respective latching hook portions 40*a* of the left-side latching arm portion 40 and right-side latching arm portion 40 of the second connection portion 13 is different from that of the latching hook portions of the tenth embodiment. In the present modification, the respective latching hook portions 40*a* are configured so that latching of the latching hook portion 40*a* with respect to the latching hole 41 is cancelled by pressing the operation portion 16*b*. Accordingly, the first connection portion 16 can be detached from the second connection portion 13 by pressing the operation portion 16*b*. A resistance that arises when cancelling latching of the latching hook portion 40*a* with respect to the latching hole 41 is preferably set to a moderate amount not to damage the elastic plate 12. In the modification of the tenth embodiment also, magnets may also be utilized for latching the first connection portion 16 and the second connection portion 13, as in the eighth embodiment and ninth embodiment.

The present invention has the following advantages.

(1) The razor head 7 is supported by only the elastic plate 12, which is located between the support portion 6 of the head portion 3 of the holder 1 and the supported portion 10 of the razor head 7. This simplifies the support structure, which supports the razor head 7 so that the razor head 7 is movable from the neutral position P against an elastic force of the elastic plate 12 can be simplified.

(2) The outer circumferential portion of the annular elastic portion 12*a* of the elastic plate 12 is supported at the inner circumferential portion of the annular portion 6*a* of the support portion 6, and the supported portion 10 of the razor head 7 is supported at the inner circumferential portion of the annular elastic portion 12*a* of the elastic plate 12. By means of this simple support structure, the razor head 7 can be moved during use from the neutral position to movement positions in three-dimensional directions against the elastic force of the elastic plate 12. Further, when using the razor head 7, the annular elastic portion 12*a* of the elastic plate 12 also acts as a cushion by means of the elasticity of the annular elastic portion 12*a*, and thus the usability of the pivoting razor is improved.

(3) In the first to ninth embodiments, the annular elastic portion 12*a* of the elastic plate 12 includes the bending-allowing portion 19 having the ridge portion 20 and the groove portion 21 in an annular shape. Consequently, it is easy to uniformly bend the annular elastic portion 12*a* of the elastic plate 12 three-dimensionally, and a cushioning characteristic of the bending-allowing portion 19 is further improved. Further, since the annular shaped ridge portion 20 of the bending-allowing portion 19 protrudes in a direction along the axis 13*a* of the tube portion 14, bending of the annular elastic portion 12*a* is facilitated in the direction of the axis 13*a* (front-rear direction X) relative to directions that are perpendicular to the axis 13*a* (the horizontal direction Y or vertical direction Z or the like). In addition, since the elastic plate 12 acts in a similar manner to a universal joint such as a ball joint, it is easy to uniformly bend the annular elastic portion 12*a* three-dimensionally.

(4) In the tenth embodiment and the modification thereof, the annular elastic portion 12*a* of the elastic plate 12 includes the bending-allowing portion 19 having the annular ridge portion 20 and groove portion 21. The bending-allowing portion 19 is formed in the shape of a substantially quadrangular ring by the left and right bending-allowing portions 43, the upper and lower bending-allowing portions 44 and the corner bending-allowing portions 45, and the elastic plate 12 acts in a similar manner to a universal joint such as a ball joint. The deformation resistance degree of the corner bending-allowing portions 45 may be higher than the deformation resistance degree of the left and right bending-allowing portions 43 and the deformation resistance degree of the upper and lower bending-allowing portions 44. The left and right bending-allowing portions 43, the upper and lower bending-allowing portions 44, and the corner bending-allowing portions 45 may also have the same deformation resistance degree. The bending-allowing portion may be configured so that the deformation resistance degree of the bending-allowing portion increases as the razor head 7 moves from the neutral position P towards the movement position. The shaving sensation can be easily changed by adjusting the deformation resistance degree of each bending-allowing portion in this manner.

(5) The first connection portion 16, which is adjacent to the blade-body assembly portion 8 of the supported portion 10 of the razor head 7, can be inserted into the second connection portion 13, which is adjacent to the elastic plate 12 only when the first connection portion 16 and the second connection portion 13 are in a predetermined positional relationship. That is, it is possible for the second connection portion 13 and the first connection portion 16 to support each other only in a case where the positioning ridge 42 of the first connection portion 16 is aligned with the positioning groove 39 of the second connection portion 13. It is thereby possible to limit a position at which coupling of the first connection portion 16 and the second connection portion 13 of the supported portion 10 of the razor head 7 is possible, and maintain the orientation of the razor head 7 constant with respect to the holder 1.

(6) With respect to the two through-holes 4*a* in the holder 1, if the razor is hung on a suspension hook using the through-hole 4*a* on the upper side, it is easy to retain the razor with the razor head 7 at the top. Further, if the razor is hung on a suspension hook using the through-hole 4*a* on the lower side, it is easy to retain the razor with the razor head 7 at the bottom. It is also possible to hang the razor on suspension hooks using both the upper and lower through-holes 4*a*. Further, if some of the finger contact portion 5, which is made of soft plastic, is exposed from the through-holes 4*a*, the finger contact portion 5 contacts the relevant suspension hook and acts to prevent slipping, and thus the razor is safely suspended from the suspension hook.

In addition to the configurations of the above embodiments, for example, the pivoting razor of the present invention may also be configured as described below.

Although the elastic plate 12, which is formed of a rubber material is used above as an elastic portion, a foamed material, a viscous-body containing member, a coil spring or a plate spring or the like may also be used.

Although an annular shape or a quadrangular shape is used above as the shape of the support portion 6, a triangular or elliptic annular shape may also be used, or a shape from which one part is notched out, such as a U shape may also be used.

A plurality of through-holes may also be arranged side by side in an annular fashion at regular intervals in the annular elastic portion 12*a* of the elastic plate 12.

The elastic portion may also be a hemispherical shape that expands on the support portion.

A portion corresponding to the elastic portion may also be made easy to bend by making walls thereof thin.

For the annular shaped elastic plate 12 of the first to ninth embodiments, a configuration may also be adopted that alters a deformation resistance degree (degree of elasticity), which indicates the degree of difficulty in deformation of the circumference of the elastic plate 12, by at least one of the following actions: making the thickness uneven, changing the shape of the ridge portion 20, and decentering the position that supports the supported portion 10 with respect to the elastic plate 12. Further, with respect to the annular elastic plate 12 according to the tenth embodiment also, a configuration may be adopted that alters the deformation resistance degree (degree of elasticity), which indicates the degree of difficulty of deformation of the circumference of the elastic plate 12, in a similar manner.

A configuration may also be adopted in which one or more thin plate portions are provided between the support portion 6 of the head portion 3 and the supported portion 10 of the razor head 7 to restrict bending of the annular elastic portion 12*a* of the elastic plate 12 in a rotational direction centering on the axis 13*a* in the front-rear direction X. The thin plate portions do not hinder bending of the annular elastic portion 12*a* of the elastic plate 12 in a direction other than the rotational direction centering on the axis 13*a* in the front-rear direction X.

A circular elastic plate 12 in which an inner plate portion extends on the inner side of the annular elastic portion 12*a* may be adopted as the elastic portion. In that case, an end portion of the supported portion can be connected to one side face in the front-rear direction X of the inner plate portion.

In the third to sixth embodiments, the notch 24 of the supported portion 10 may also be provided with a pair of latching arms that sandwiches the strip portion 23 when the strip portion 23 of the blade-body assembly portion 8 is inserted into the notch 24. The latching arms are configured so that the strip portion 23 is not dislocated from between the pair of latching arms.

In the eighth embodiment, a magnet 35 may be provided at the respective positions at which the outer circumference of the tube portion 14 of the second connection portion 13 faces the inner circumference of the first connection portion 16, with the two magnets 35 being configured to attach to each other.

In the first, eighth, and ninth embodiments, by adopting a configuration in which the second connection portion 13 is partially or entirely made transparent and/or a window hole is provided in the second connection portion 13, the first connection portion 16 and the second connection portion 13 can be connected to each other in a state in which the first connection portion 16 is being viewed through the second connection portion 13 from the outside of the second connection portion 13.

The elastic portion may also be provided with a pump function to enable the supply of a liquid or gel shaving aid to the razor head from the elastic portion. For example, a configuration may be adopted so that a shaving aid is supplied to the skin surface or the razor head accompanying pivoting during use. Further, a configuration may be adopted that supplies a shaving aid to the razor head when the razor head is moved by hand immediately prior to use.

In the tenth embodiment, a configuration may also be adopted in which a latching arm is provided on the cap 46, so that when the razor head 7 is covered with the cap 46, the latching arm of the cap 46 is latched onto the support portion 6 of the head portion 3 to restrict pivoting of the razor head 7.

A configuration may also be adopted in which a switching member that is capable of selectively engaging and disengaging the head portion 3 and the razor head 7 is provided between the head portion 3 and the razor head 7, to enable switching of the razor head 7 between a pivoting enabled state and a pivoting disabled state.

The invention claimed is:

1. A pivoting razor comprising:

a holder having a head portion;

a razor head having a blade body;

a support portion provided in the head portion of the holder;

a supported portion provided in the razor head; and an elastic portion that is arranged between the support portion and the supported portion, wherein the razor head is arranged to be movable between a neutral position, in which the razor head is retained in a static state by the elastic portion, and a movement position, which is separated from the neutral position, the razor head moves from the neutral position to the movement position against an urging force of the elastic portion, and the razor head returns to the neutral position from the movement position by means of an urging force of the elastic portion, and the elastic portion has a plurality of bending-allowing portions that have different deformation resistance degrees, which indicate a degree of difficulty of deformation.

2. The pivoting razor according to claim 1, wherein the bending-allowing portions of the elastic portion are arranged adjacent to each other.

3. The pivoting razor according to claim 2, wherein the bending-allowing portions of the elastic portion are arranged to form an annular shape around the supported portion of the razor head.

4. The pivoting razor according to claim 1, wherein the bending-allowing portions of the elastic portion change shape as the razor head moves from the neutral position to a movement position, and the deformation resistance degree of the bending-allowing portions at the movement position is higher than the deformation resistance degree of the bending-allowing portions at the neutral position.

5. A pivoting razor comprising:

a holder having a head portion;

a razor head having a blade body;

a support portion that is provided in the head portion of the holder and that has an annular portion that annularly extends to define a support hole on an inner side thereof;

a supported portion that is provided in the razor head, that has a tube portion, and that has an outer circumference; and an elastic portion that is arranged between the support portion and the supported portion, that includes an annular elastic portion, which is located in the support hole and between an inner circumference of the annular portion of the support portion and the outer circumference of the supported portion, the annular elastic portion extending along the inner circumference of the annular portion and the outer circumference of the supported portion, and a bending-allowing portion that is formed in the annular elastic portion, and that has a ridge portion that continuously extends along the circumference of the tube portion and protrudes along an axis of the tube portion, and a groove portion that is formed on the back of the ridge portion, wherein the razor head is arranged to be movable between a neutral position, in which the razor head is retained in a static state by the elastic portion, and a movement position, which is separated from the neutral position, and the razor head moves from the neutral position to the movement position against an urging force of the elastic portion, and the razor head returns to the neutral position from the movement position by means of an urging force of the elastic portion.

6. The pivoting razor according to claim 5, wherein the elastic portion has an outer circumferential portion that is supported by the support portion of the head portion.

7. The pivoting razor according to claim 6, wherein the elastic portion supports the supported portion of the razor head at a position that is inward of the outer circumferential portion of the elastic portion.

8. The pivoting razor according to claim 7, wherein the elastic portion is an elastic plate.

9. The pivoting razor according to claim 8, wherein the supported portion of the razor head is supported by at least one of two side faces in a thickness direction of the elastic plate.

10. The pivoting razor according to claim 5, wherein the holder includes a grip portion provided integrally with the head portion, and the grip portion is formed integrally with the elastic portion of the head portion and has an exposed finger contact portion.

11. The pivoting razor according to claim 5, wherein the elastic portion has a hardness within a range of 20 Shore A to 60 Shore A.

12. The pivoting razor according to claim 5, wherein when the razor head is at the neutral position, the elastic portion is located inside the support hole and between the annular portion of the support portion and the supported portion of the razor head.

13. The pivoting razor according to claim 12, wherein the supported portion of the razor head includes:

a first connection portion that extends from a blade-body assembly portion in which the blade body is mounted;

a second connection portion with the elastic portion being located between the support portion of the head portion and the second connection portion; and a coupling portion at which the first connection portion and the second connection portion support each other, wherein, when the razor head is at the neutral position, an end portion that is separated from the blade-body assembly portion in the second connection portion is located in the support hole.

14. The pivoting razor according to claim 5, wherein the ridge portion extends concentrically with the tube portion at the circumference of the tube portion.

15. The pivoting razor according to claim 5, wherein the ridge portion protrudes in a direction away from the razor head.

* * * * *